US009970147B2

(12) United States Patent
Del Pos et al.

(10) Patent No.: US 9,970,147 B2
(45) Date of Patent: May 15, 2018

(54) LAUNDRY WASHING MACHINE

(71) Applicant: Electrolux Appliances Aktiebolag, Stockholm (SE)

(72) Inventors: Maurizio Del Pos, Pordenone (IT); Daniele Favaro, Venice (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 10 days.

(21) Appl. No.: 14/765,977

(22) PCT Filed: Feb. 6, 2013

(86) PCT No.: PCT/EP2013/052303
§ 371 (c)(1),
(2) Date: Aug. 5, 2015

(87) PCT Pub. No.: WO2014/121824
PCT Pub. Date: Aug. 14, 2014

(65) Prior Publication Data
US 2015/0368846 A1 Dec. 24, 2015

(51) Int. Cl.
*D06F 39/00* (2006.01)
*D06F 39/02* (2006.01)
(Continued)

(52) U.S. Cl.
CPC ..... *D06F 39/007* (2013.01); *D06F 39/005* (2013.01); *D06F 39/02* (2013.01);
(Continued)

(58) Field of Classification Search
CPC ..... D06F 39/007; D06F 39/02; D06F 9/022; D06F 9/028; A47L 15/4229
(Continued)

(56) References Cited

U.S. PATENT DOCUMENTS 3,148,687 A 9/1964 Dosch
3,386,582 A * 6/1968 Brezosky ..... A47L 15/4229 210/136
(Continued)

FOREIGN PATENT DOCUMENTS

DE 3520202 A1 12/1986
DE 3521598 A1 * 12/1986 ..... D06F 39/007
(Continued)

OTHER PUBLICATIONS

Heissmeier, "Program-controlled domestic washing machine" Dec. 1986, DE 3521598—Machine Translation.*
(Continued)

*Primary Examiner* — David G Cormier
*Assistant Examiner* — Thomas Bucci
(74) *Attorney, Agent, or Firm* — Ratnerprestia

(57) ABSTRACT

Laundry machine has a detergent dispensing assembly, a fresh-water supply circuit for selectively channeling a fresh water flow towards the detergent dispensing assembly, and a water softening device including a softening container having softening agent along the fresh-water supply circuit. A regeneration-agent reservoir fluidically connected to the softening container receives a regeneration agent. A water supply circuit channels fresh water into the regeneration-agent reservoir. The softening device includes an automatic one-way valve on a first fresh-water supply line upstream of the softening container, allowing water to only flow along the first fresh-water supply line, from a water mains to the softener container. An electrically-controlled valve assembly/flow diverter, located along the first fresh-water supply line, downstream of the one-way valve and upstream of the softening container, selectively allows/prevents the water to freely flow towards, respectively, the softening container and the softening device water supply circuit.

17 Claims, 7 Drawing Sheets

(51) Int. Cl.
*D06F 39/08* (2006.01)
*D06F 39/12* (2006.01)

(52) U.S. Cl.
CPC ..... *D06F 39/022* (2013.01); *D06F 39/028* (2013.01); *D06F 39/083* (2013.01); *D06F 39/088* (2013.01); *D06F 39/12* (2013.01)

(58) Field of Classification Search
USPC ..... 68/13 A, 17 R, 12.18, 207, 13 R, 200, 68/23.5; 134/57 D, 58 D, 115 R, 93, 109, 134/56 D, 18, 26, 29, 36, 7; 210/190, 210/191, 136, 140, 141, 687, 167.01; 222/651, 129, 325, 1, 132, 145.5, 189.11, 222/318
See application file for complete search history.

(56) References Cited

U.S. PATENT DOCUMENTS

| | | | | |
|---|---|---|---|---|
| 6,557,382 | B1 | 5/2003 | Koike et al. | |
| 6,766,812 | B1 | 7/2004 | Gadini | |
| 2006/0117811 | A1 | 6/2006 | Kinnetz | |
| 2006/0191299 | A1 | 8/2006 | Tobias et al. | |
| 2009/0266115 | A1* | 10/2009 | Cao | D06F 39/007 68/13 A |
| 2010/0000027 | A1 | 1/2010 | Bae et al. | |
| 2010/0139328 | A1* | 6/2010 | Favaro | D06F 39/022 68/12.18 |

FOREIGN PATENT DOCUMENTS

| | | | | |
|---|---|---|---|---|
| DE | 3527047 | A1 | 2/1987 | |
| DE | 10245281 | A1 * | 4/2004 | D06F 39/02 |
| DE | 102008027726 | B3 | 10/2009 | |
| EP | 0496957 | A1 | 8/1992 | |
| EP | 1085118 | A2 | 3/2001 | |
| EP | 2113602 | A1 | 11/2009 | |
| EP | 2554739 | A1 * | 2/2013 | D06F 39/007 |
| WO | 2011128745 | A2 | 10/2011 | |
| WO | WO 2011128745 | A2 * | 10/2011 | A61K 8/19 |
| WO | 2011154426 | A1 | 12/2011 | |
| WO | WO 2011154426 | A1 * | 12/2011 | A47L 15/4229 |

OTHER PUBLICATIONS

Stamminger, "Domestic washing machine for domestic laundry" Apr. 2004, DE 10245281—Machine Translation.*
International Search Report dated Jun. 6, 2013 in related International Application No. PCT/EP2013/073778.
International Search Report dated May 29, 2013 in related International Application No. PCT/EP2013/052275.
International Search Report dated May 29, 2013 in related International Application No. PCT/EP2013/052272.
International Search Report dated Jun. 4, 2013 in related International Application No. PCT/EP2013/052299.
International Search Report dated Jun. 4, 2013 in related International Application No. PCT/EP2013/052303.

* cited by examiner

LAUNDRY WASHING MACHINE

BACKGROUND

The present invention relates to a laundry washing machine.

More in details, the present invention relates to a front-loading home laundry washing machine provided with an internal water softening device, to which the following description refers purely by way of example without this implying any loss of generality.

As is known, currently marketed front-loading home laundry washing machines generally comprise: a substantially parallelepiped-shaped outer boxlike casing structured for resting on the floor; a substantially bell-shaped washing tub which is suspended in floating manner inside the casing, directly facing a laundry loading/unloading through opening realized in the front wall of the casing; a substantially cylindrical elastically-deformable bellows, which connects the front opening of the washing tub to the laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; a substantially cylindrical, bell-shaped rotatable drum structured for housing the laundry to be washed, and which is arranged inside the washing tub with its concavity facing the laundry loading/unloading opening and is supported in axially rotating manner so as to be able to freely rotate about its substantially horizontally-oriented longitudinal axis; and finally an electrically-powered motor assembly which is structured for driving into rotation the rotatable drum about its longitudinal axis inside the washing tub.

Alike any other home laundry washing machine, this type of laundry washing machine is furthermore provided with a detergent dispensing assembly which is generally located inside the boxlike casing, immediately above the washing tub, and is structured for selectively feeding into the washing tub, according to the washing cycle manually-selected by the user via a control panel generally located on the front wall of the boxlike casing, a given amount of detergent, softener and/or other washing agent suitably mixed with fresh water arriving from the water mains; and with a fresh-water supply circuit which is structured for selectively drawing fresh water from the water mains according to the washing cycle manually-selected by the user, and channelling said water to the detergent dispensing assembly or directly to the washing tub.

The detergent dispensing assembly, in turn, generally comprises: a detergent drawer which is usually divided into a number of detergent compartments each structured for being manually fillable with a corresponding detergent product, and which is fitted/inserted in manually extractable manner into a completely recessed drawer housing whose entrance is usually located on front wall of the casing, above the laundry loading/unloading opening, and whose bottom directly communicates with the inside of the washing tub via a connecting duct; and a drawer flush circuit which receives the fresh water from the fresh-water supply circuit, and is structured to selectively and alternatively channel said fresh water into any one of the detergent compartments of the detergent drawer, so as to selectively flush the detergent, softener or other washing agent out of the corresponding detergent compartment and down on the bottom of the drawer housing which, in turn, communicates with the inside of the washing tub.

As is known the hardness of the fresh water channelled into the washing tub deeply negatively influences the cleaning efficiency of the detergents and softeners used in the washing cycle, thus the user is usually requested to considerably increase, when the hardness degree of the fresh water is too high, the amount of detergent and softener used in the washing cycle and/or to mix the detergent with a given amount of very expensive, generally polycarboxylates-based, water-softening chemical product.

German patent application No. 3527047 discloses a laundry washing machine provided with an internal water softening device capable of reducing the hardness degree of the fresh water used in the pre-washing, washing and rinsing phases of the washing cycle. This water softening device is arranged upstream of the detergent dispensing assembly, and uses a ions-exchange agent to restrain the calcium and magnesium ions (Ca++ an Mg++) dissolved in the fresh water channelled to the washing tub, and the brine (i.e. salt water) to periodically regenerate this ions-exchange agent. Salt water, in fact, is able to remove from the ions-exchange agent the calcium and magnesium ions previously combined/fixed to said ions-exchange agent.

European patent application No. 1085118, in turn, discloses a front-loading home laundry washing machine wherein the internal water softening device is deeply integrated into the back of detergent dispensing assembly so as to reduce the overall production costs of the laundry washing machine.

Unluckily integration of the salt reservoir on the back of the detergent drawer causes several relevant problems. The brine accidentally coming out of the salt reservoir during drawer movement, in fact, tends to accumulate on the bottom of the drawer housing which in turn directly communicates with the upper portion of the washing tub. Thus the brine can reach quite easily the outer surface of the rotatable drum with all problems concerned. The rotatable drum, in fact, is generally made of metal material and gets rusty very quickly in presence of brine.

Furthermore, the capacity of the salt reservoir on the back of the detergent drawer is too limited for the everyday-use typical of a traditional home laundry washing machine. It is unacceptable for a normal user to refill the salt reservoir every 3-4 washing cycles.

SUMMARY OF SELECTED INVENTIVE ASPECTS

An aim of the present invention is therefore to realize an internal water softening device designed to eliminate the drawbacks referred above.

In compliance with the above aims, according to an aspect of the present invention, there is provided a laundry washing machine comprising an outer casing and, inside said outer casing, a control unit, a washing tub, a rotatable drum housed in axially rotatable manner inside the washing tub and structured for housing the laundry to be washed, a detergent dispensing assembly which is structured for supplying detergent, softener or other washing agent into the washing tub, a fresh-water supply circuit which is structured for selectively channeling a flow of fresh water from the water mains towards the detergent dispensing assembly and/or the washing tub, and a water softening device which is arranged/located along the fresh-water supply circuit and is structured for reducing the hardness degree of the fresh water channeled to the detergent dispensing assembly and/or the washing tub; the fresh-water supply circuit comprising at least a first fresh-water supply line which is connected to the water mains and is structured for selectively conveying into the washing tub the detergent, softener or other washing agent of the detergent dispensing assembly; the water softening device in turn comprising a water-softening agent container which is arranged/located along said first fresh-water supply line and is filled with a water softening agent able to reduce the hardness degree of the fresh water flowing through the same water-softening agent container: a regeneration-agent reservoir which is fluidically connected to the water-softening agent container and is structured to receive a consumable regeneration agent for performing a regeneration of the water softening function of the water softening agent stored into the water-softening agent container; and a water supply circuit which is structured for channelling fresh water into the regeneration-agent reservoir so to at least partly dissolve the regeneration agents stored therein and form some brine; the laundry washing machine being characterized in that the water softening device furthermore comprises: a passive one-way valve not controllable by the control unit, arranged along the first fresh-water supply line upstream of the water-softening agent container, and structured so as to allow the fresh water to only flow along the first fresh-water supply line, from the water mains to the water-softening agent container and not vice versa; and an electrically-controlled valve assembly or flow diverter which is located along the first fresh-water supply line, downstream of the one-way valve and upstream of the water-softening agent container, and structured for selectively allowing or preventing the fresh water of the water mains to flow towards, respectively, the water-softening agent container and the water supply circuit of the water softening device.

Preferably, though not necessarily, the laundry washing machine is furthermore characterized in that the water softening device furthermore comprises a water by-pass circuit which branches off from the first fresh-water supply line upstream of the water-softening agent container, and is structured for selectively channelling, directly towards the detergent dispensing assembly, the fresh water that flows along the first fresh-water supply line towards the water-softening agent container, so as to bypass at once the water-softening agent container; the water by-pass circuit being connected to the electrically-controlled valve assembly or flow diverter and said electrically-controlled valve assembly or flow diverter being structured for selectively allowing or preventing the fresh water of the water mains to freely flow also towards said water by-pass circuit.

Preferably, though not necessarily, the laundry washing machine is furthermore characterized in that the first fresh-water supply line is structured for connecting the water mains to a washing-agent container of the detergent dispensing assembly, so as to selectively flush/push into the washing tub the detergent, softener or other washing agent contained into said washing-agent container; and in that the water by-pass circuit is structured for selectively channelling, directly towards the washing-agent container of the detergent dispensing assembly connected to the first fresh-water supply line bypassing at once the water-softening agent container, the fresh water that flows along the first fresh-water supply line.

Preferably, though not necessarily, the laundry washing machine is furthermore characterized in that the water softening device furthermore comprises an electrically-powered brine-circulating pump assembly or valve assembly which is interposed between the water-softening agent container and the regeneration-agent reservoir and is structured for regulating/controlling the outflow of the brine from the regeneration-agent reservoir to the water-softening agent container.

Preferably, though not necessarily, the laundry washing machine is furthermore characterized in that the water softening device furthermore comprises a water drain line which is structured for selectively channelling/rerouting the brine or fresh water that comes out from the water-softening agent container, directly into the washing tub or into a waste-water drain line that channels the waste water or washing liquor out of the laundry washing machine, so to bypass the detergent dispensing assembly.

Preferably, though not necessarily, the laundry washing machine is furthermore characterized in that said first fresh-water supply line comprises a first pipeline or the like which connects the water mains to the inlet of the water-softening agent container, a second pipeline or the like which connects the outlet of the water-softening agent container to the detergent dispensing assembly, and an electrically-controlled on-off valve which is located along the first pipeline so as to be able to control/regulate the flow of fresh water from the water mains to the detergent dispensing assembly and the water-softening agent container; the automatic one-way valve and the electrically-controlled valve assembly or flow diverter being located downstream of the electrically-controlled on-off valve of the first fresh-water supply line.

Preferably, though not necessarily, the laundry washing machine is furthermore characterized in that the detergent dispensing assembly comprises a number of washing-agent containers each of which is manually fillable with a given quantity of detergent, softener or other washing agent, and in that the first fresh-water supply line is structured for selectively channelling the fresh water from the water mains directly to the washing-agent container of the detergent dispensing assembly structured to contain the detergent or other washing agent to be used in the main-wash phase of the washing cycle.

Preferably, though not necessarily, the laundry washing machine is furthermore characterized in that the fresh-water supply circuit comprises further independent fresh-water supply lines each of which is independently connected to the water mains and is structured for selectively and independently channelling the fresh water from the water mains to a respective remaining washing-agent container of the detergent dispensing assembly.

Preferably, though not necessarily, the laundry washing machine is furthermore characterized in that each further independent fresh-water supply line comprises a connecting pipeline which directly connects the water mains to the corresponding washing-agent container of the detergent dispensing assembly; and an electrically-controlled on-off valve which is located along said connecting pipeline so as to be able to control regulate the flow of fresh water from the water mains to said washing-agent container of the detergent dispensing assembly.

Preferably, though not necessarily, the laundry washing machine is furthermore characterized in that the detergent dispensing assembly comprises one or more washing-agent containers each manually fillable with a given quantity of detergent, softener and/or other washing agent, and the/each washing-agent container of the detergent dispensing assembly is provided with a corresponding loading inlet or mouth which is exposed or exposable to the outside of the casing on a front wall of the casing, and is structured for allowing the user to load the requested detergent, softener and/or other washing agent into the same washing-agent container; and in that the regeneration-agent reservoir, in turn, is provided with a corresponding loading inlet or mouth which is exposed or exposable to the outside of the casing on the front wall of the casing, beside the exposed or exposable loading inlet or mouth of the/each washing-agent container of the detergent dispensing assembly, and is structured for allowing the user to load the consumable salt or other regeneration agent inside the same regeneration-agent reservoir.

Preferably, though not necessarily, the laundry washing machine is furthermore characterized by also comprising an appliance control panel which is structured for allowing the user to manually select the desired washing cycle between washing cycles that use non-softened fresh water during the main-wash phase of the washing cycle, and washing cycles that use softened fresh water during the main-wash phase of the washing cycle.

Preferably, though not necessarily, the laundry washing machine is furthermore characterized in that the regeneration-agent reservoir is recessed/incorporated into a drawer-like supporting structure which is fitted/inserted in manually extractable manner into a corresponding drawer housing which extends preferably substantially horizontally inside the casing and communicates with the outside via a front entrance or opening realized on the same front wall of casing; said drawer-like supporting structure being movable between a retracted position in which the drawer-like supporting structure is completely recessed/inserted into the drawer housing, so as to place the loading inlet or mouth of the regeneration-agent reservoir completely inside the casing, and an extracted position in which the drawer-like supporting structure partly juts out from the front wall of the casing so as to place the loading inlet or mouth of the regeneration-agent reservoir outside of the casing.

Preferably, though not necessarily, the laundry washing machine is furthermore characterized in that regeneration-agent reservoir is recessed/incorporated into the drawer-like supporting structure in manually removable manner.

Preferably, though not necessarily, the laundry washing machine is furthermore characterized in that the appliance control panel is located on the front wall of the casing substantially astride of the vertical center-plane of the casing, so to be substantially vertically aligned to a laundry loading/unloading opening realized on the same front wall of the casing; and in that the exposed or exposable loading inlet or mouth of the/each washing-agent container of the detergent dispensing assembly and the exposed or exposable loading inlet or mouth of the regeneration-agent reservoir are arranged on the front wall of the casing on opposite sides of the appliance control panel.

Preferably, though not necessarily, the laundry washing machine is furthermore characterized in that the appliance control panel is located on a front side of the drawer-like supporting structure carrying the regeneration-agent reservoir.

Preferably, though not necessarily, the laundry washing machine is furthermore characterized in that the regeneration-agent reservoir is provided with a loading inlet or mouth which is exposed or exposable to the outside of the casing on a worktop of the casing.

Preferably, though not necessarily, the laundry washing machine is furthermore characterized in that the regeneration-agent reservoir comprises a substantially basin-shaped, regeneration-agent container which is manually fillable with a given quantity of consumable salt or other regeneration agent, and is located/recessed into the casing so that the upper mouth of the basin-shaped container is freely accessible by the user.

Preferably, though not necessarily, the laundry washing machine is furthermore characterized in that the regeneration-agent reservoir comprises a storage tank which is structured for being manually fillable with a given quantity of consumable salt or other regeneration agent, and a manually-removable cap which is structured to close the storage tank.

Preferably, though not necessarily, the laundry washing machine is furthermore characterized in that the manually-removable cap is structured to close the storage tank in watertight manner.

Preferably, though not necessarily, the laundry washing machine is furthermore characterized in that the regeneration-agent reservoir furthermore comprises an overflow drain line which is structured for directly channelling the water or brine eventually exceeding the maximum capacity of the storage tank towards the washing tub or towards a waste-water drain line that channels the waste water or washing liquor out of the laundry washing machine.

Preferably, though not necessarily, the laundry washing machine is furthermore characterized in that the detergent dispensing assembly comprises a detergent drawer which is fitted/inserted in manually extractable manner into a corresponding drawer housing which extends inside the casing while remaining above the washing tub, and communicates with the outside of the casing via a front entrance or opening realized on a front wall of the casing.

Preferably, though not necessarily, the laundry washing machine is furthermore characterized in that the detergent drawer is divided into a number of detergent compartments each structured for being manually fillable with a given amount of detergent, softener and/or other washing agent, and each forming a respective washing-agent container of the detergent dispensing assembly.

BRIEF DESCRIPTION OF THE DRAWINGS

A non-limiting embodiment of the present invention will now be described, by way of example, with reference to the accompanying drawings, in which:

FIG. 7 is a partial and schematic view of a portion of the internal water softening device of the FIG. 5 laundry washing machine; whereas

DETAILED DESCRIPTION OF EXAMPLE EMBODIMENTS

Figure 2:
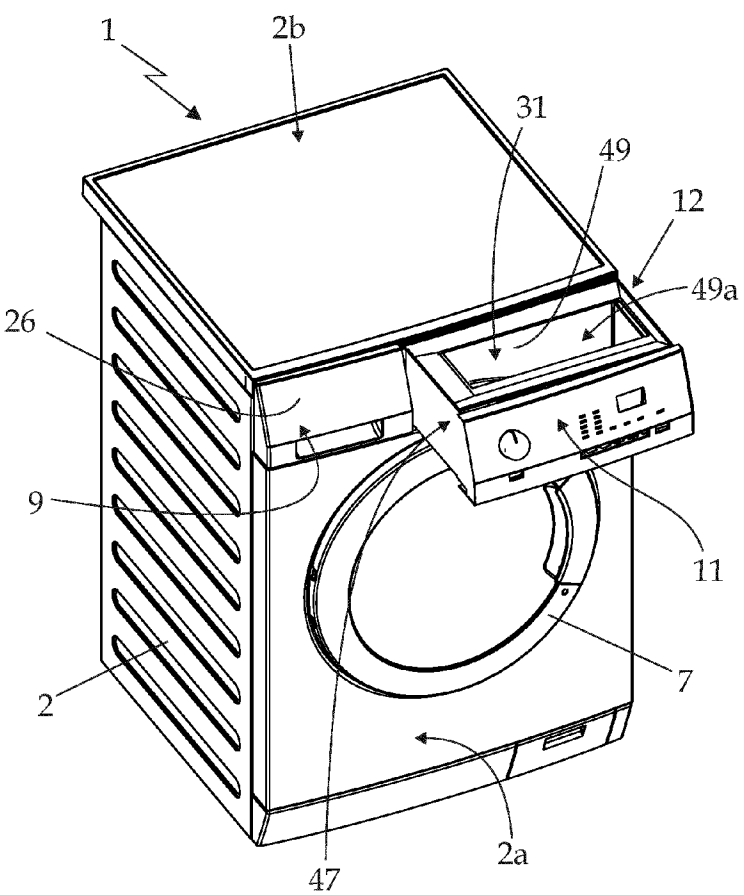
FIG. 2 is a perspective view of the FIG. 1 laundry washing machine in a different working configuration.
Figure 1:
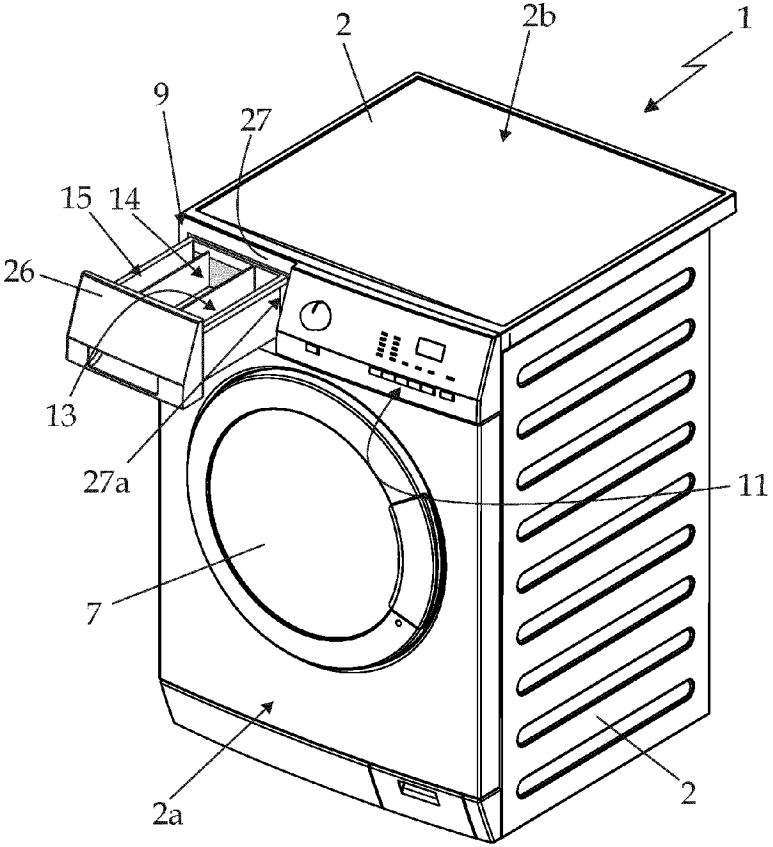
FIG. 1 is a perspective view of a front-loading, home laundry washing machine realized in accordance with the teachings of the present invention.
Figure 3:
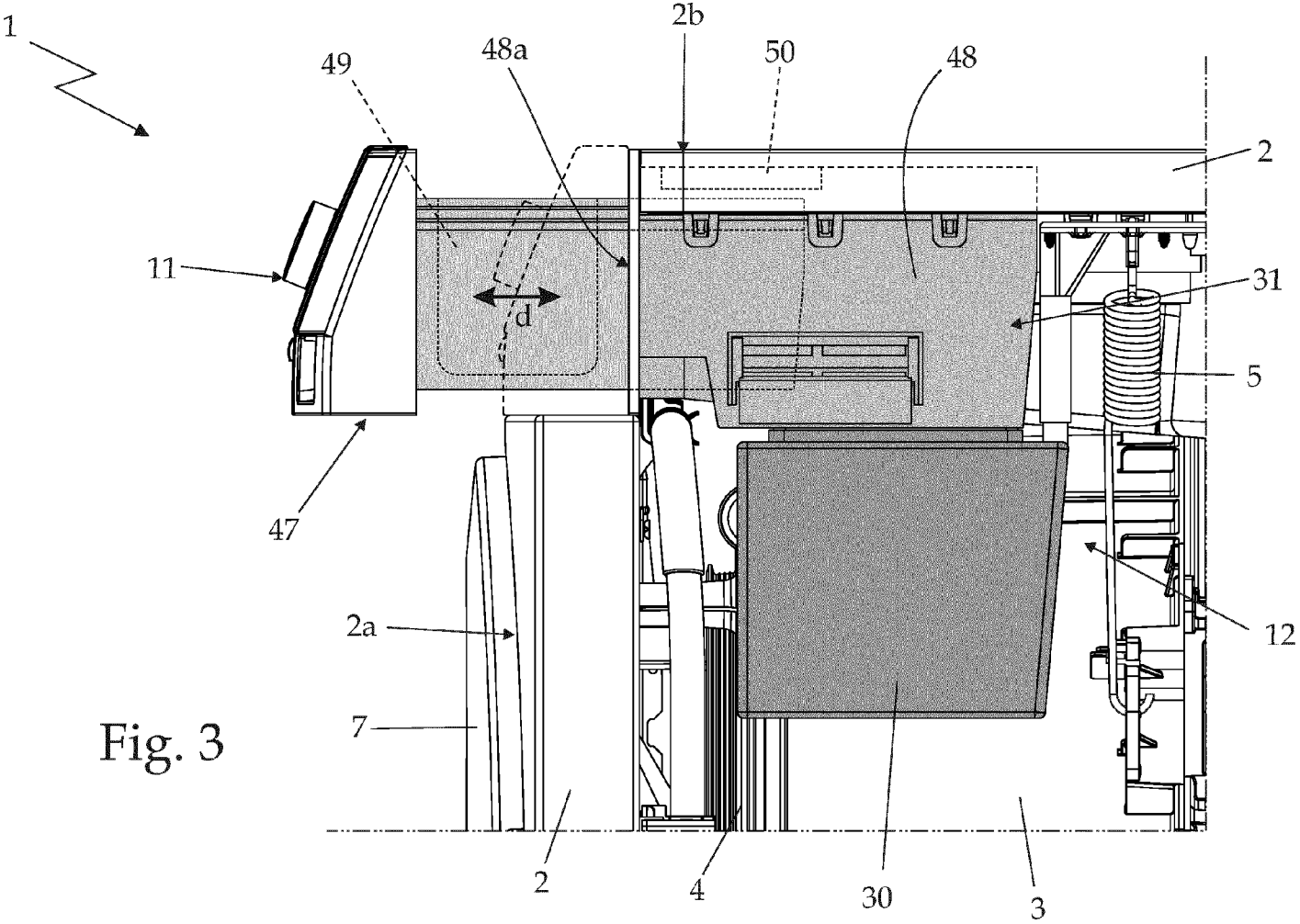
FIG. 3 is a side view of the FIG. 1 laundry washing machine with parts removed for clarity and partly disclosing the internal water softening device of the washing machine.

With reference to FIGS. 1, 2 and 3, reference number 1 indicates as a whole a home laundry washing machine which comprises: a preferably, though not necessarily, substantially parallelepiped-shaped, rigid outer boxlike casing 2 which is structured for resting on the floor; a preferably substantially cylindrical, bell-shaped hollow washing tub 3 which is arranged inside the casing 2 with its opening or mouth directly facing a laundry loading/unloading through opening realized in the front wall 2*a* of boxlike casing 2; a preferably substantially cylindrical, elastically-deformable bellows 4 watertight connecting the front opening or mouth of washing tub 3 to the laundry loading/unloading opening realized in the front wall 2*a* of casing 2; and a substantially cylindrical, bell-shaped rotatable drum (not shown) structured for housing the laundry to be washed, and which is housed in axially rotatable manner inside the washing tub 3 so as to be able to freely rotate about its longitudinal reference axis.

In the example shown, in particular, the laundry loading/unloading opening is preferably realized on front wall 2*a* of casing 2 substantially astride of the vertical center-plane of the casing 2, and the washing tub 3 is preferably arranged inside the boxlike casing 2 with its longitudinal reference axis substantially horizontally-oriented, i.e. substantially perpendicular to front wall 2*a*. The rotatable drum (not shown), in turn, is housed in axially rotating manner inside the washing tub 3 with its front opening directly faced/aligned to the laundry loading/unloading opening on front wall 2*a*, and the drum rotation axis is preferably arranged locally substantially coincident with the substantially horizontally-oriented longitudinal reference axis of washing tub 3.

Furthermore in the example shown the hollow washing tub 3 is preferably suspended in floating manner inside the casing 2 via a suspension system preferably, though not necessarily, comprising a couple of upper coil springs 5 connecting the upper portion of the washing tub 3 to the top of the boxlike casing 2, and a number of lower vibration dampers (not shown) connecting the bottom portion of the washing tub 3 to the bottom of casing 2.

With reference to FIGS. 1, 2, 3 and 4, the laundry washing machine 1 furthermore comprises:

- a porthole door 7 which is hinged to the front wall 2*a* of casing 2 to rotate about a preferably, though not necessarily, vertically-oriented reference axis to and from a closing position in which the peripheral border of the porthole door 7 rests completely on front wall 2*a* for closing the laundry loading/unloading opening and watertight sealing the washing tub 3;
- an electrically-powered motor assembly (not shown) which is structured for driving into rotation the rotatable drum about its longitudinal reference axis inside the washing tub 3;
- a detergent dispensing assembly 9 which is housed inside the casing 2 in easily reachable manner by the user, and is structured for selectively feeding into the washing tub 3, according to the selected washing cycle, a given amount of detergent, softener and/or other washing agent preferably suitably mixed with the fresh water arriving from the water mains, or even simply a given amount of fresh water arriving from the water mains; and
- a fresh-water supply circuit 10 which is structured for being connected to the water mains and for selectively channelling the fresh water from the water mains to the detergent dispensing assembly 9 and/or to the washing tub 3, preferably while controlling/regulating the flow of fresh water towards the detergent dispensing assembly 9 and/or the washing tub 3.

In addition to the above, the laundry washing machine 1 furthermore comprises an appliance control panel 11 which is structured for allowing the user to manually select the desired washing-cycle and is preferably located on front wall 2*a* of casing 2, above the laundry loading/unloading opening and preferably also immediately underneath a preferably substantially horizontally oriented, worktop or top wall 2*b* of the casing 2; and an internal water softening device 12 which is located inside the casing 2, and is structured for selectively reducing, during each washing cycle, the hardness degree of the fresh water flowing from the water mains to the detergent dispensing assembly 9 and/or to the washing tub 3.

Figure 4:
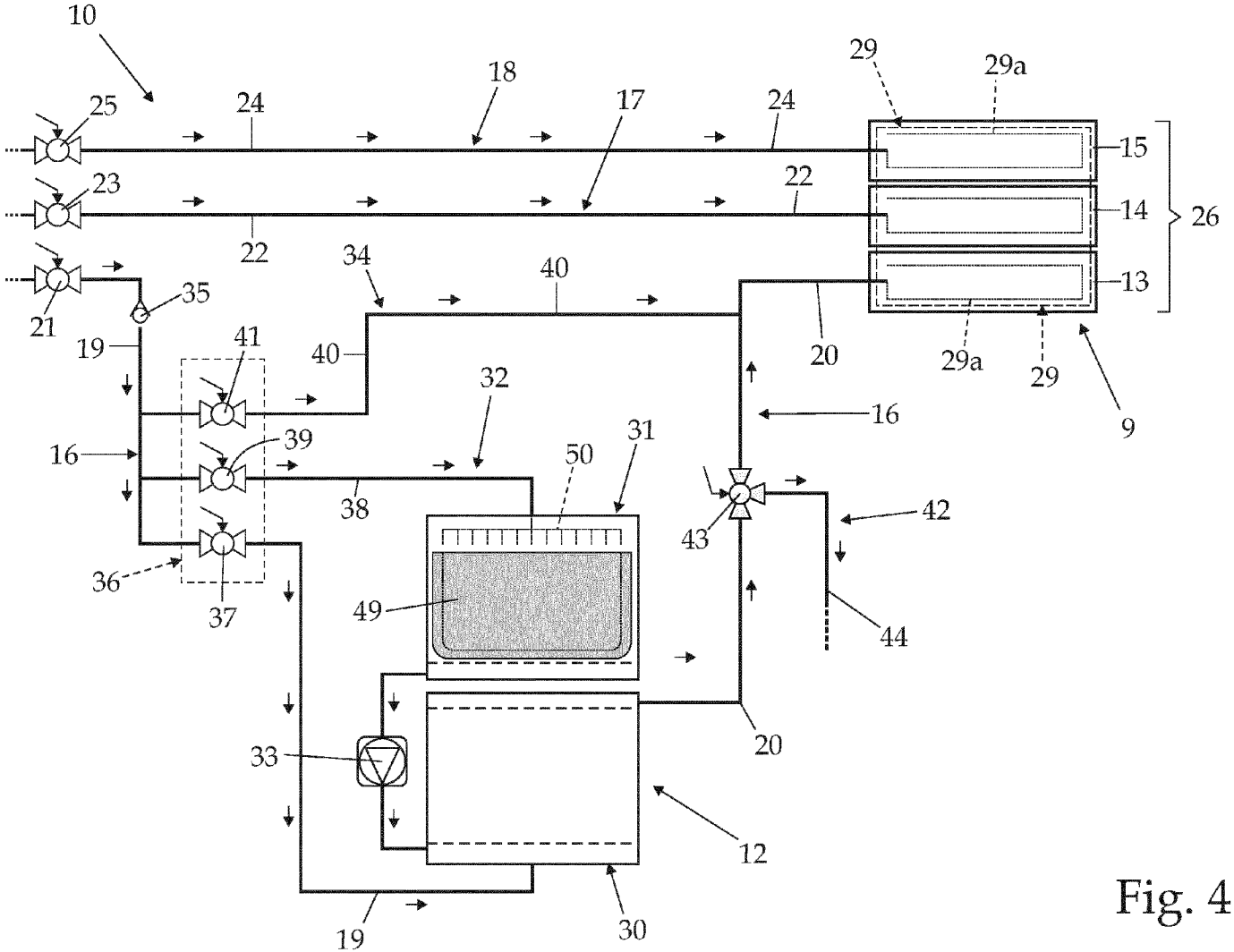
FIG. 4 is a schematic view of the internal water softening device of the FIG. 1 laundry washing machine, with parts removed for clarity.

More in details, with reference to FIGS. 1 and 4, the detergent dispensing assembly 9 comprises at least one and preferably a number/plurality of internal washing-agent containers each of which is manually fillable with a given quantity of detergent, softener and/or other washing agent, and is located into a corresponding container housing realized inside the casing 2. Each internal washing-agent container of the detergent dispensing assembly 9 is furthermore provided with a corresponding loading inlet or mouth which is exposed or exposable to the outside of casing 2 and is structured for allowing the user to timely load the requested detergent, softener and/or other washing agent into the same washing-agent container.

The quantity of detergent, softener and/or other washing agent stored into the/each internal washing-agent container of the detergent dispensing assembly 9 may be sufficient either for a single washing cycle or for several consecutive washing cycles.

Preferably the detergent dispensing assembly 9 is furthermore arranged inside the casing 2 so that the exposed or exposable loading inlet or mouth of the/each internal washing-agent container is located/arranged on front wall 2*a* of casing 2, preferably, though not necessarily, above the laundry loading/unloading opening, so as to be easily reachable by the user at any time.

In other words, the loading inlets or mouths of the various internal washing-agent containers of the detergent dispensing assembly 9 are preferably accessible by the user through one or more corresponding pass-through opening/s preferably realized on front wall 2*a* of casing 2, preferably, though not necessarily, above the laundry loading/unloading opening on the same front wall 2*a*.

In the example shown, in particular, the detergent dispensing assembly 9 preferably comprises three internal washing-agent containers 13, 14, 15 each of which is manually fillable with a given quantity of detergent, softener and/or other washing agent, to be used in a corresponding phase of the washing cycle.

More in particular, the internal washing-agent container 13 is structured to contain the detergent or other washing agent to be used in the main-wash phase of the washing cycle; the internal washing-agent container 14 is preferably structured to contain the detergent or other washing agent to be used in the pre-wash phase of the washing cycle; and finally the internal washing-agent container 15 is preferably structured to contain the softener, stain-remover or other washing agent to be used in the final-wash phase of the washing cycle.

With reference to FIG. 4, the fresh-water supply circuit 10, in turn, comprises at least one fresh-water supply line which is connected to the water mains and is structured for selectively conveying into the washing tub 3 the detergent, softener or other washing agent of the detergent dispensing assembly 9.

More in details, the fresh-water supply circuit 10 preferably comprises at least one fresh-water supply line which is structured for connecting the water mains to one or more of the internal washing-agent containers 13, 14, 15 of detergent dispensing assembly 9, so as to selectively flush/push into the washing tub 3 the detergent, softener or other washing agent contained into the same washing-agent container/s 13, 14, 15.

In the example shown, in particular, the fresh-water supply circuit 10 preferably comprises a number/plurality of independent fresh-water supply lines, each of which is independently connected to the water mains and is structured for selectively and independently channelling the fresh water from the water mains directly to at least one respective washing-agent container 13, 14, 15 of the detergent dispensing assembly 9, so as to selectively flush/push into the washing tub 3 a given amount of the detergent, softener or other washing agent contained into the same washing-agent container 13, 14, 15 or simply a given amount of fresh water arriving from the water mains.

More in particular, in the example shown, each fresh-water supply line of the fresh-water supply circuit 10 is preferably, though not necessarily, structured for selectively channelling the fresh water from the water mains directly to a respective and unique washing-agent container 13, 14, 15 of the detergent dispensing assembly 9, so as to selectively flush/push into the washing tub 3 a given amount of the detergent, softener or other washing agent contained into the same washing-agent container 13, 14, 15 or simply a given amount of fresh water arriving from the water mains.

More in details, in the example shown the fresh-water supply circuit 10 preferably comprises three independent fresh-water supply lines 16, 17, 18, each independently connected to the water mains.

The fresh-water supply line 16 is structured for selectively channelling a given amount of fresh water from the water mains solely directly to the main internal washing-agent container 13. The fresh-water supply line 17 is structured for selectively channelling a given amount of fresh water from the water mains solely directly to the washing-agent container 14. The fresh-water supply line 18 is structured for selectively channelling a given amount of fresh water from the water mains solely directly to the washing-agent container 15.

With reference to FIG. 4, the water softening device 12 is preferably arranged/located along the fresh-water supply line 16 of the fresh-water supply circuit 10, so as to be crossed by the fresh water flowing from the water mains to the internal washing-agent container 13 of detergent dispensing assembly 9, and is structured so as to be able to reduce the hardness degree of the fresh water flowing from the water mains to the internal washing-agent container 13 structured to contain the detergent or other washing agent to be used in the main-wash phase of the washing cycle.

The independent fresh-water supply line 16 of fresh-water supply circuit 10 therefore comprises: a first pipeline 19 or the like which connects the water mains to the inlet of the internal water softening device 12; a second pipeline 20 or the like which connects the outlet of the internal water softening device 12 to the internal washing-agent container 13 of detergent dispensing assembly 9; and an electrically-controlled on-off valve 21, which is located along the pipeline 19 so as to be able to control/regulate the flow of fresh water from the water mains to the internal washing-agent container 13 of detergent dispensing assembly 9 and, as a consequence, to the internal water softening device 12.

In the example shown, in particular, the on-off valve 21 is preferably fixed/attached to the rear wall of the casing 2.

With reference to FIG. 4, the independent fresh-water supply line 17 of fresh-water supply circuit 10, in turn, preferably comprises: a pipeline 22 or the like which directly connects the water mains to the corresponding washing-agent container 14 of the detergent dispensing assembly 9; and an electrically-controlled on-off valve 23 which is located along the pipeline 22 so as to be able to control/regulate the flow of fresh water from the water mains to the washing-agent container 14 of detergent dispensing assembly 9.

Likewise on-off valve 21, in the example shown also on-off valve 23 is preferably fixed/attached to the rear wall of the casing 2.

Similarly to fresh-water supply line 17, also the independent fresh-water supply line 18 of fresh-water supply circuit 10 preferably comprises: a pipeline 24 or the like which directly connects the water mains to the corresponding washing-agent container 15 of the detergent dispensing assembly 9; and an electrically-controlled on-off valve 25 which is located along the pipeline 24 so as to be able to control/regulate the flow of fresh water from the water mains to the washing-agent container 15 of detergent dispensing assembly 9.

Likewise on-off valves 21 and 23, in the example shown also on-off valve 25 is preferably fixed/attached to the rear wall of the casing 2.

With reference to FIGS. 1, 2 and 4, in the example shown, in particular, the detergent dispensing assembly 9 preferably comprises a detergent drawer 26 which is fitted/inserted in manually extractable manner into a corresponding, completely recessed, substantially basin-shaped, drawer housing 27 which, starting from the front wall 2*a* of casing 2, extends preferably substantially horizontally inside the casing 2 while remaining above the washing tub 3, and moreover communicates with the outside of casing 2 via a front entrance or opening 27*a* realized on front wall 2*a* of casing 2 preferably immediately above the laundry loading/unloading opening.

The detergent drawer 26 is therefore manually movable inside the drawer housing 27 in a preferably substantially horizontally-oriented, displacement direction between a working position (see FIG. 2) in which the detergent drawer 26 is completely recessed into the drawer housing 27 preferably while at same time closing the front entrance or opening 27*a* of drawer housing 27, and a completely extracted position (see FIG. 1) in which the detergent drawer 26 partly juts out from the front wall 2*a* of casing 2 through the front entrance or opening 27*a* of the corresponding drawer housing 27.

In the example shown, in particular, the drawer housing 27 is preferably arranged inside the casing 2 so as to locate its front entrance or opening 27*a* substantially on the upper right corner of the front wall 2*a* of casing 2; whereas the detergent drawer 26 is preferably movable inside the drawer housing 27 along a substantially horizontally-oriented, displacement direction which is also locally substantially perpendicular to the front wall 2*a* of casing 2.

With reference to FIGS. 1 and 4, the detergent drawer 26 is furthermore divided into a number (three in the example shown) of detergent compartments each of which is structured for being manually fillable with a given amount of detergent, softener and/or other washing agent preferably sufficient to perform a single washing cycle, and each of said detergent compartments forms a respective internal washing-agent container 13, 14, 15 of the detergent dispensing assembly 9.

With reference to FIG. 4, each independent fresh-water supply line 16, 17, 18 of the fresh-water supply circuit 10, in turn, is preferably structured for selectively and independently channelling the fresh water of the water mains towards a corresponding detergent compartment 13, 14, 15 of detergent drawer 26, so as to selectively flush the detergent, softener or other washing agent out of said detergent compartment 13, 14, 15 and down on the bottom of drawer housing 27 which, in turn, directly communicates with the inside of washing tub 3 via a corresponding connecting duct (not shown), so as to be able to channel towards the washing tub 3 the detergent, softener or other washing agent dropping out of any one of the various detergent compartment 13, 14, 15 of detergent drawer 26.

More specifically, in the example shown each fresh-water supply line 16, 17, 18 of the fresh-water supply circuit 10 is preferably structured for selectively spilling/pouring a dense shower of water droplets by gravity into a respective detergent compartment 13, 14, 15 of detergent drawer 26.

With reference to FIG. 4, in the example shown, in particular, the fresh-water supply circuit 10 preferably comprises a sprinkler head 29 which is associated to the drawer housing 27 of detergent drawer 26 so as to be located immediately above the detergent drawer 26 when the latter is completely inserted/recessed into the same drawer housing. This sprinkler head 29 is provided with a number (three in the example shown) of shower-making portions/sections 29*a* each of which is preferably substantially vertically aligned to a corresponding detergent compartment 13, 14, 15 of detergent drawer 26, and is structured for feeding a shower of water droplets by gravity into said detergent compartment 13, 14, 15; and each fresh-water supply line 16, 17, 18 of the fresh-water supply circuit 10 is structured to selectively channel the fresh water of the water mains towards a corresponding shower-making portion/section 29*a* of the sprinkler head 29.

In other words, pipeline 20 of fresh-water supply line 16 is directly connected to a first shower-making portion/section 29*a* of the sprinkler head 29, so as to selectively spill/pour a dense shower of water droplets by gravity into the beneath-located detergent compartment 13 of detergent drawer 26. Pipeline 22 of fresh-water supply line 17 is directly connected to a second shower-making portion/section 29*a* of the sprinkler head 29, so as to selectively spill/pour a dense shower of water droplets by gravity into the beneath-located detergent compartment 14 of detergent drawer 26. Pipeline 22 of fresh-water supply line 18 is directly connected to a third shower-making portion/section 29*a* of the sprinkler head 29, so as to selectively spill/pour a dense shower of water droplets by gravity into the beneath-located detergent compartment 15 of detergent drawer 26.

With reference to FIGS. 1, 2, 3 and 4, the internal water softening device 12, in turn, is internally provided with a given amount of water softening agent which is able to reduce the hardens degree of the fresh water flowing through the same water softening device 12, and with a given amount of consumable salt or other regeneration agent which is able to regenerate the water softening function of the water softening agent. The internal water softening device 12 is moreover provided with an exposed or exposable loading inlet or mouth which is structured for allowing the user to timely load the consumable salt or other regeneration agent inside the same water softening device 12.

More in details, the internal water softening device 12 basically comprises a water-softening agent container 30 and a regeneration-agent reservoir 31, both housed inside the boxlike casing 2.

The water-softening agent container 30 is located along the fresh-water supply line 16 of the fresh-water supply circuit 10, i.e. between pipelines 19 and 20 of fresh-water supply line 16, so as to be crossed by the fresh water flowing from the water mains to the internal washing-agent container or detergent compartment 13, and is filled with a water softening agent able to reduce the hardness degree of the fresh water flowing through the same water-softening agent container 30.

The regeneration-agent reservoir 31, in turn, is structured for receiving a given quantity of consumable salt or other regeneration agent which is able to regenerate the water softening function of the water softening agents stored inside the water-softening agent container 30, and is fluidically connected to the water-softening agent container 30 for selectively transferring a mixture of water and salt, or other regeneration agent, to the water-softening agent container 30.

The regeneration-agent reservoir 31 is moreover provided with a loading inlet or mouth which is structured for allowing the user to timely load the consumable salt or other regeneration agent inside the same regeneration-agent reservoir 31, and is arranged/located inside the casing 2 so that its loading inlet or mouth is exposed or exposable to the outside of casing 2 independently from the exposed or exposable loading inlet/s or mouth/s of the internal washing-agent containers 13, 14, 15 of the detergent dispensing assembly 9.

In other words, the exposed or exposable loading inlet or mouth of the regeneration-agent reservoir 31 is preferably accessible by the user through a corresponding pass-through opening which is preferably realized either on worktop 2*b* of casing 2, or on front wall 2*a* of casing 2 preferably, though not necessarily, above the laundry loading/unloading opening on the same front wall 2*a*.

With reference to FIG. 4, the internal water softening device 12 furthermore comprises:

- a water supply circuit 32 which branches off from the fresh-water supply line 16 upstream of water-softening agent container 30, and is structured for selectively channelling, into the regeneration-agent reservoir 31, the fresh water that flows along the fresh-water supply line 16, so as to at least partly dissolve the salt or other regeneration agents stored inside the regeneration-agent reservoir 31 and form therein a given amount of brine (i.e. of salt water); and
- an electrically-powered brine-circulating pump 33 which is interposed between the water-softening agent container 30 and the regeneration-agent reservoir 31 and is structured for transferring/moving, when activated, the brine (i.e. the salt water) from the regeneration-agent reservoir 31 to the water-softening agent container 30.

Preferably, the electrically-powered brine-circulating pump 33 is moreover structured for transferring/moving, when activated, the brine (i.e. the salt water) from the regeneration-agent reservoir 31 to the water-softening agent container 30, and for completely watertight sealing/isolating, when deactivated, the regeneration-agent reservoir 31 from the water-softening agent container 30 so as to prevent the brine (i.e. the salt water) store in the regeneration-agent reservoir 31 from flowing towards the water-softening agent container 30.

According to a less sophisticated embodiment, the electrically-powered brine-circulating pump 33 may obviously be replaced by an electrically-powered pump assembly comprising a conventional electrically-powered suction pump and an on-off valve which is arranged immediately upstream of the suction pump and is structured to watertight seal the suction/inlet of the electrically-powered suction pump when the latter is deactivated, and to put the suction/inlet of the electrically-powered suction pump in direct communication with the inside of the regeneration-agent reservoir 31 when the suction pump is activated.

In addition to the above, the internal water softening device 12 preferably furthermore comprises a water by-pass circuit 34 which branches off from the fresh-water supply line 16 upstream of the water-softening agent container 30, and is structured for selectively channelling, directly towards the detergent dispensing assembly 9, the fresh water that flows along the fresh-water supply line 16 towards the water-softening agent container 30, so as to bypass at once the water-softening agent container 30.

More in details, in the example shown the water by-pass circuit 34 is preferably structured for selectively channelling, directly into the internal washing-agent container or detergent compartment 13 of detergent dispensing assembly 9, the fresh water that flows along the fresh-water supply line 16 directed towards the water-softening agent container 30, so as to bypass at once the water-softening agent container 30.

The water by-pass circuit 34, therefore, allows to selectively channel non-softened fresh water directly to the internal washing-agent container or detergent compartment 13 structured to contain the detergent or other washing agent to be used in the main-wash phase of the washing cycle.

In view of the above, the appliance control panel 11 is preferably, though not necessarily, furthermore structured so to allow the user to manually select the desired washing cycle between washing cycles that use normal, i.e. non-softened, fresh water during the main-wash phase of the washing cycle, washing cycles that use softened fresh water during the main-wash phase of the washing cycle, and optionally also washing cycles that use a mixture of softened and normal, i.e. non-softened, fresh water during the main-wash phase of the washing cycle.

With reference to FIG. 4, the internal water softening device 12 moreover comprises:

- a passive one-way valve 35 not controllable by the control unit of the laundry washing machine and arranged along the fresh-water supply line 16 upstream of the water-softening agent container 30, i.e. along pipeline 19 of fresh-water supply line 16, and is structured so as to allow the fresh water to only flow along pipeline 19 of fresh-water supply line 16, from the water mains to the water-softening agent container 30 of water softening device 12 and not vice versa; and
- an electrically-controlled valve assembly 36 which is located along the fresh-water supply line 16, downstream of the one-way valve 35 and upstream of the water-softening agent container 30, and is structured so to selectively allow or prevent the fresh water of the water mains to freely flow towards, respectively, the water-softening agent container 30, the water supply circuit 32 and, if present, the water by-pass circuit 34.

It is to be stressed that differently from the above mentioned passive one-way valve 35, the valve/s or valve assembly or flow diverter mentioned in the present description and denoted as "electrically-controlled" are to be intended as operated by the control unit of the laundry washing machine.

In the example shown, in particular, the water-softening agent container 30 preferably has a water inlet connected to pipeline 19 of fresh-water supply line 16, and a water outlet connected to pipeline 20 of fresh-water supply line 16, so as to be crossed by the fresh water flowing from the water mains to the shower-making portion/section 29*a* of sprinkler head 29 located above the detergent compartment 13 of detergent drawer 26.

The water-softening agent container 30 is therefore fluidically interposed between the water mains and the internal washing-agent container or detergent compartment 13 structured to contain the detergent or other washing agent to be used in the main-wash phase of the washing cycle.

More in details, in the example shown the water-softening agent container 30 is preferably filled with a given amount of ion-exchange resins (not shown) capable to restrain the calcium and/or magnesium ions (Ca++ an Mg++) dissolved in the fresh water flowing across the same water-softening agent container 30. The ion-exchange resins (not shown) stored into the water-softening agent container 30, hereinafter also referred to as the resin container 30, form the water softening agents of the water softening device 12.

The regeneration-agent reservoir 31, in turn, is structured for receiving/containing a given amount (for example half a Kilo or one Kilo) of salt grains (Sodium Chloride) or similar consumable regeneration chemical agent, and is provided with an exposable loading inlet or mouth which is structured for allowing the user to timely load the consumable salt or other regeneration agent inside the same regeneration-agent reservoir 31, and is exposed or exposable to the outside of casing 2 so as to be easily reachable by the user at any time. The regeneration-agent reservoir 31 is furthermore dimensioned to contain an amount of brine (i.e. of salt water) sufficient for performing several resin regeneration processes.

With reference to FIG. 4, the valve assembly 36 instead preferably comprises an electrically-controlled on-off valve 37 which is located along the fresh-water supply line 16, downstream of downstream of the one-way valve 35 and upstream of the water-softening agent container 30, i.e. along pipeline 19 of fresh-water supply line 16, so as to be able to selectively and alternatively allow or prevent the fresh water arriving from the water mains to freely flow towards the water-softening agent container 30.

The water supply circuit 32 of water softening device 12, in turn, preferably comprises a connecting pipeline 38 or the like that branches off from the fresh-water supply line 16, i.e. from pipeline 19 of fresh-water supply line 16, between the one-way valve 35 and the on-off valve 37, and is structured to channel the fresh water flowing along the fresh-water supply line 16 towards the regeneration-agent reservoir 31; and an electrically-controlled on-off valve 39 which is located along connecting pipeline 38 so to be able to selectively and alternatively allow or prevent the fresh water arriving from the water mains to freely flow along connecting pipeline 36, towards the regeneration-agent reservoir 31.

The electrically-controlled on-off valve 39 is therefore fluidically directly interposed between the fresh-water supply line 16 and the regeneration-agent reservoir 31, and forms part of the valve assembly 36.

Still with reference to FIG. 4, the water by-pass circuit 34, in turn, preferably comprises a connecting pipeline 40 or the like that branches off from the fresh-water supply line 16, i.e. from pipeline 19 of fresh-water supply line 16, between the one-way valve 35 and the on-off valve 37, and is structured to channel the fresh water flowing along the fresh-water supply line 16 directly towards the detergent dispensing assembly 9, bypassing at once the water-softening agent container 30; and an electrically-controlled on-off valve 41 which is located along the connecting pipeline 40, so to be able to selectively and alternatively allow or prevent the fresh water arriving from the water mains to freely flow along connecting pipeline 40, directly towards the detergent dispensing assembly 9 while bypassing at once the whole water-softening agent container 30.

More specifically, in the example shown, the connecting pipeline 40 branches off from pipeline 19 of fresh-water supply line 16, between the one-way valve 35 and the on-off valve 37, and preferably joints pipeline 20 of fresh-water supply line 16 downstream of water-softening agent container 30, so as to be able to channel directly into the internal washing-agent container or detergent compartment 13 of detergent dispensing assembly 9, the fresh water flowing along the fresh-water supply line 16.

The electrically-controlled on-off valve 40 is fluidically directly interposed between the fresh-water supply line 16 and the detergent dispensing assembly 9, and forms part of the valve assembly 36.

In addition to the above, the internal water softening device 12 preferably furthermore comprises a water-level sensor (not shown) which is structured for measuring the level of the fresh water and/or brine contained inside the regeneration-agent reservoir 31, and/or a salinity-level sensor (not shown) which is structured for measuring the salinity degree of the brine contained inside the regeneration-agent reservoir 31.

Furthermore the internal water softening device 12 is preferably also provided with a water-hardness sensor (not shown) which is structured for measuring the hardness degree of the water coming out from the water-softening agent container 30 and directed towards the internal washing-agent container or detergent compartment 13 structured to contain the detergent or other washing agent to be used in the main-wash phase of the washing cycle.

In the example shown, in particular, the water-level sensor and/or the salinity-level sensor and/or the water-hardness sensor is/are able to communicate with an internal electronic central control unit (not shown) which is housed inside the boxlike casing 2 and controls all electrically-operated component parts of the laundry washing machine 1.

With reference to FIG. 4, preferably the internal water softening device 12 furthermore comprises an auxiliary water drain line 42 which is structured for selectively channelling/rerouting directly into the washing tub 3 the brine or fresh water that comes out from the resin container 30 and flows along pipeline 20 of fresh-water supply line 16 directed towards the internal washing-agent container or detergent compartment 13 of detergent dispensing assembly 9, so as to bypass at once the whole internal washing-agent container or detergent compartment 13 of detergent dispensing assembly 9.

In other, words, the water drain line 42 branches off from the fresh-water supply line 16 downstream of the water-softening agent container 30, and is structured for selectively channelling/rerouting directly into the washing tub 3 the brine or fresh water that comes out from the water-softening agent container 30, so as to bypass at once the internal washing-agent container or detergent compartment 13.

In the example shown, in particular, the water drain line 40 preferably comprises, along pipeline 20 of fresh-water supply line 16, an electrically-controlled three-way valve 43 which has a first outlet in direct communication with the internal washing-agent container or detergent compartment 13 through the pipeline 19, and a second outlet connected to a pipeline 44 or the like that ends directly into the washing tub 3.

The electrically-controlled three-way valve 43 is structured for selectively and alternatively channelling the brine or softened fresh water coming out of the resin container 30 either to the washing tub 3 via the pipeline 44, or to the internal washing-agent container or detergent compartment 13 via pipeline 20 of fresh-water supply line 16.

As an alternative, the water drain line 42 may be structured for selectively channelling the brine or fresh water coming out from the resin container 30 into the drain sump (not shown) that extends downwards form the bottom of the washing tub 3, or into the water filtering assembly (not shown) that is interposed between the drain sump (not shown) of washing tub 3 and the suction of either the water circulating pump (not shown) or the water exhaust pump (not shown) of the laundry washing machine 1, or substantially directly into the water exhaust pump (not shown) which drains the waste water or washing liquor outside of the laundry washing machine 1, or in any case into the waste-water drain line (not shown) that channels the waste water or washing liquor outside the laundry washing machine 1.

Thus pipeline 44 of water drain line 42 may optionally end into the drain sump (not shown) of washing tub 3, or into the water filtering assembly (not shown), or into the water exhaust pump (not shown), or into the waste-water drain line (not shown) of the laundry washing machine 1.

In addition to the above, with reference to FIGS. 1, 2 and 3, in the example shown the internal water softening device 12 is preferably located/arranged inside the casing 2 so that the exposed or exposable loading inlet or mouth of the regeneration-agent reservoir 31 is accessible by the user through a corresponding pass-through opening realized on front wall 2*a* of casing 2, above the laundry loading/unloading opening present on the same front wall 2*a*.

Furthermore the water softening device 12 is preferably located/arranged inside the casing 2 so that the exposed or exposable loading inlet or mouth of the regeneration-agent reservoir 31 is arranged on front wall 2*a* of casing 2, beside the exposed or exposable loading inlet/s or mouth/s of the washing-agent containers 13, 14 and 15 of detergent dispensing assembly 9.

In other words, the regeneration-agent reservoir 31 is located/recessed inside the casing 2, so that the internal washing-agent containers 13, 14, 15 of detergent dispensing assembly 9, i.e. detergent compartments 13, 14, 15 of detergent drawer 26, and the regeneration-agent reservoir 31 are independently exposable to the outside on front wall 2*a* of casing 2 one beside the other, for being independently accessible by the user at any moment.

More in details, in the example shown, the regeneration-agent reservoir 31 is preferably recessed/incorporated into a drawer-like supporting structure 47 which is fitted/inserted in manually extractable manner into a corresponding, substantially completely recessed, drawer housing 48 which, starting from the front wall 2*a*, extends preferably substantially horizontally inside the casing 2 and communicates with the outside via a front entrance or opening 48*a* realized on the same front wall 2*a* of casing 2. The drawer-like supporting structure 47 is therefore movable in a preferably substantially horizontally-oriented, displacement direction d between

- a retracted position (see FIG. 1) in which the drawer-like supporting structure 47 is completely recessed/inserted into the drawer housing 48, so as to place the loading inlet or mouth of the regeneration-agent reservoir 31 completely inside the casing 2 and hide, i.e. make inaccessible to the user, the same loading inlet or mouth of the regeneration-agent reservoir 31; and
- a completely extracted position (see FIGS. 2 and 3) in which the drawer-like supporting structure 47 partly juts out from the front wall 2*a* of casing 2 through the front entrance or opening 48*a* of drawer housing 48, so as to place the loading inlet or mouth of the regeneration-agent reservoir 31 outside of casing 2 for allowing easy refilling of the regeneration-agent reservoir 31.

In other words, the internal water softening device 12 is at least partly located/incorporated into the drawer-like supporting structure 47, so that the loading inlet or mouth of the regeneration-agent reservoir 31 is freely accessible by the user when the drawer-like supporting structure 47 is arranged in the completely extracted position (see FIGS. 2 and 3), and is completely hidden and inaccessible by the user when the drawer-like supporting structure 47 is arranged in the retracted position (see FIG. 1).

In the example shown, in particular, the drawer housing 48 preferably extends substantially horizontally inside the casing 2 while remaining above the washing tub 3, and communicates with the outside via a front entrance or opening 48*a* which is realized on front wall 2*a* of casing 2, immediately above the laundry loading/unloading opening on front wall 2*a* and preferably also horizontally beside the exposed or exposable loading inlet or mouth of the internal washing-agent containers 13, 14, 15 of detergent dispensing assembly 9. The drawer-like supporting structure 47 is preferably furthermore movable inside the drawer housing 48 along a substantially horizontally-oriented, displacement direction d which is also locally substantially perpendicular to the front wall 2*a* of casing 2.

In addition to the above, the drawer-like supporting structure 47 is preferably, though not necessarily, fitted/inserted in manually extractable manner into the front wall 2*a* of the casing 2 substantially at the upper left corner of the front wall 2*a*.

Moreover the appliance control panel 11 is preferably, though not necessarily, located on a front side of the drawer-like supporting structure 47, so to be arranged substantially coplanar to the front wall 2*a* of casing 2 when the drawer-like supporting structure 47 is in the retracted position (see FIG. 1); and so to be arranged forward spaced apart from the front wall 2*a* of casing 2 when the drawer-like supporting structure 47 is in the extracted position (see FIGS. 2 and 3).

With reference to FIGS. 2, 3 and 4, in the example shown, in particular, the regeneration-agent reservoir 31 preferably comprises a substantially basin-shaped, regeneration-agent container 49 which is manually fillable with a given quantity of consumable salt or other regeneration agent, and is moreover located/incorporated into the drawer-like supporting structure 47 of the appliance control panel 11, so that the upper mouth 49*a* of the basin-shaped container 49 is freely accessible by the user when the drawer-like supporting structure 47 is arranged in the completely extracted position (see FIGS. 2 and 3), and is preferably completely hidden and inaccessible by the user when the drawer-like supporting structure 47 is arranged in the retracted position (see FIG. 1).

The water supply circuit 32 of water softening device 12, in turn, is structured for channelling, on command, a given amount of fresh water into the basin-shaped container 49 so to at least partly dissolve the salt or other regeneration agents stored therein and form a given amount of brine (i.e. of salt water).

Being freely accessible by the user, the upper mouth 49*a* of the basin-shaped container 49 allows the user to load the consumable salt or other regeneration agent inside the regeneration-agent reservoir 31, and therefore forms the exposable loading inlet or mouth of the regeneration-agent reservoir 31. The exposable loading inlet or mouth of the regeneration-agent reservoir 31 is thus exposable to the outside on front wall 2*a* of casing 2.

In addition to the above, the bottom portion of the drawer housing 48 of the drawer-like supporting structure 47 is preferably, though not necessarily, shaped/structured so as to form a catchment basin wherein the brine coming out of the basin-shaped container 49 accumulates, and the suction of the brine-circulating pump 33 directly communicates with the bottom of drawer housing 48, so that the brine-circulating pump 33 is able to selectively pump the brine from the bottom of drawer housing 48 to the resin container 30.

As an alternative, the bottom of the substantially basin-shaped, regeneration-agent container 47 may be directly connected to the suction of the brine-circulating pump 33 via a specific flexible hosepipe, so that the brine-circulating pump 33 is able to selectively pump the brine from the basin-shaped container 49 to the resin container 30.

As disclosed in advanced, the water softening device 12 is preferably also provided with a water-level sensor (not shown) which is structured for measuring the level of the brine contained into the basin-shaped container 49, and/or with a salinity-level sensor (not shown) which is structured for measuring the salinity degree of the brine contained into the basin-shaped container 49.

With reference to FIGS. 3 and 4, the water supply circuit 32 of water softening device 12, in turn, is preferably structured for channelling, on command, a given amount of fresh water into the basin-shaped container 49 so to at least partly dissolve the salt or other regeneration agents stored therein and form a given amount of brine (i.e. of salt water).

In the examples shown, in particular, the water supply circuit 32 is preferably structured for spilling/pouring a shower of the water droplets by gravity directly into the basin-shaped container 49 when the drawer-like supporting structure 47 is arranged in the retracted position (see FIG. 1).

More in details, with reference to FIGS. 3 and 4, similarity the fresh-water supply circuit 10, the water supply circuit 32 of water softening device 12 preferably comprises a sprinkler head 50 which is associated to the drawer housing 48 of the drawer-like supporting structure 47 so as to be located immediately above the basin-shaped container 49 when the drawer-like supporting structure 47 is arranged in the retracted position. The sprinkler head 50 is provided with a shower-making portion/section which preferably, though not necessarily, extends above the whole basin-shaped container 49, and is structured for feeding a shower of water droplets by gravity into the basin-shaped container 49; and the connecting pipeline 38 of water supply circuit 32 ends directly into said sprinkler head 50.

Preferably, though not necessarily, the electrically-controlled on-off valve 39 of water supply circuit 32 is furthermore dimensioned so as to have a nominal flow rate substantially equal to the nominal flow rate of the brine-circulating pump 33, so that the brine-circulating pump 33 is able to transfer/move the brine little by little from the regeneration-agent reservoir 31 to the resin container 30, thus minimising the permanency of the brine on the bottom of either the basin-shaped container 49 or the drawer housing 48.

With reference to FIGS. 3 to 4, the water-softening agent container 30, in turn, is preferably, though not necessarily, located immediately beneath the drawer-like supporting structure 47 carrying the appliance control panel 11, or more precisely immediately beneath the drawer housing 48 of the drawer-like supporting structure 47, so as to be substantially vertically aligned to the regeneration-agent reservoir 31 when the drawer-like supporting structure 47 is arranged in the retracted position.

In other words, the water-softening agent container 30 is preferably located below the drawer housing 48 of the drawer-like supporting structure 47 carrying the appliance control panel 11, within an approximately triangular pocket seat or compartment delimited by the sidewall of the boxlike casing 2, the upper portion of the washing tub 3 and the front wall 2*a* of casing 2.

In the example shown, in particular, the resin container 30 is preferably, though not necessarily, attached to the bottom of the drawer housing 48 immediately beside the upper portion of washing tub 3, so as to internally face the front wall 2*a* of casing 2.

Moreover, the resin container 30 preferably, though not necessarily, includes a completely stand-alone modular cartridge 30 which is provided with mechanical coupling members (not shown) structured for allowing a rigid and stable, though easily releasable, fastening of the stand-alone modular component-part or cartridge 30 directly to the bottom of the drawer housing 48 of the drawer-like supporting structure 47, and with hydraulic connectors (not shown) structured for allowing the stable, though easily detachable, hydraulic connection of the stand-alone modular cartridge 30 to the independent fresh-water supply line 16 and to the outlet of the brine-circulating pump 33.

In other words, a first hydraulic connector (not shown) of the stand-alone modular cartridge 30 is connected to the first section of pipeline 19 of fresh-water supply line 16, so as to allow the inflow of the fresh water into the resin container 30; a second hydraulic connector (not shown) of the stand-alone modular cartridge 30 is connected to the second section of pipeline 19 of fresh-water supply line 16 so to allow the outflow of the fresh water from the resin container 30 towards the internal washing-agent container or detergent compartment 13; and a third hydraulic connector (not shown) of the stand-alone modular cartridge 30 is structured to directly communicate with the outlet of the brine-circulating pump 33 so as to allow the controlled inflow of the brine (i.e. the salt water) into the resin container 30.

General operation of home laundry washing machine 1 is clearly inferable from the above description. During the washing cycle, the electronic central control unit (not shown) of the laundry washing machine 1 opens, selectively and preferably one by one, the on-off valves 21, 23 and 25 of the fresh-water supply lines 16, 17 and 18 according to a time sequence that depends on the washing cycle previously select by the user, so as to perform, in sequence, all phases of the washing cycle.

During the main-wash phase of the washing cycle, assuming that the three-way valve 43 of water softening device 12 is already configured so to put the resin container 30 in direct communication with the main washing-agent container or detergent compartment 13 of detergent dispensing assembly 9, the central control unit (not shown) of laundry washing machine 1 opens the on-off valve 21 of fresh-water supply line 16 and the on-off valve 37 of valve assembly 36, so as to allow the fresh water of the water mains to flow along the fresh-water supply line 16 towards the resin container 30 of water softening device 12.

The one-way valve 35 is out of the control of the central control unit (not shown) of laundry washing machine 1 and automatically allows the fresh water to flow along fresh-water supply line 16, from the water mains to the water-softening agent container 30.

While flowing through the resin container 30 of water softening device 12, the fresh water is subjected to the action of the ion-exchange resins and the hardness degree of the fresh water directed to the main internal washing-agent container or detergent compartment 13 of detergent dispensing assembly 9 is reduced.

The water-hardness sensor monitors the hardness degree of the fresh water directed to the main internal washing-agent container or detergent compartment 13 of detergent dispensing assembly 9.

After having crossed the resin container 30, the softened fresh water of the water mains reaches the main internal washing-agent container 13 of the detergent dispensing assembly 9, i.e. drips by gravity into the main detergent compartment 13 of detergent drawer 26, so as to selectively flush/push into the washing tub 3 a given amount of the detergent, softener or other washing agent contained into the same main internal washing-agent container or detergent compartment 13, or to simply drop into the washing tub 3.

If the selected washing cycle requires the use of non-softened fresh water during the main-wash phase of the washing cycle, the central control unit (not shown) of laundry washing machine 1 may alternatively open the on-off valve 21 of fresh-water supply line 16 and the on-off valve 41 of water by-pass circuit 34, so as to allow the fresh water of the water mains to flow along the fresh-water supply line 16 and the water by-pass circuit 34, towards the main washing-agent container or detergent compartment 13 of detergent dispensing assembly 9 bypassing at once the resin container 30.

Also in this case the one-way valve 35 automatically allows the fresh water to flow along fresh-water supply line 16, from the water mains to the water by-pass circuit 34.

When determines that the ion-exchange resins inside the resin container 30 are no more able to reduce the hardness degree of the fresh water directed to the washing tub 3, the electronic central control unit (not shown) of laundry washing machine 1 performs, preferably immediately before the starting of the rinsing phase of the washing cycle, a regeneration process of the ion-exchange resins stored inside the resin container 30.

Obviously the regeneration process may also take place during the washing phase of the washing cycle, or can take place even when no washing cycle at all is running, preferably on specific request of the user.

Assuming that the on-off valve 21 of the fresh-water supply line 16 and the on-off valves 37, 39 and 41 of electrically-controlled valve assembly 36 are all closed, at beginning of the regeneration process, the central control unit of laundry washing machine 1 opens the on-off valve 21 of fresh-water supply line 16 and the on-off valve 39 of water supply circuit 32 for enough time to channel into the regeneration-agent reservoir 30, i.e. into the basin-shaped container 49, an amount of fresh water sufficient to form, into the regeneration-agent reservoir 30, the whole amount of brine (i.e. of salt water) necessary for the resin regeneration process to take place.

When the requested amount of fresh water has reached the regeneration-agent reservoir 30, i.e. the basin-shaped container 49, the central control unit of laundry washing machine 1 closes again the on-off valve 39 of water supply circuit 32 and preferably, though not necessarily, also the on-off valve 21 of fresh-water supply line 16.

When the requested amount of brine is formed into the regeneration-agent reservoir 30, the central control unit of laundry washing machine 1 configures the three-way valve 43 of water drain line 42 so as to put the outlet of the resin container 30 in direct communication with the pipeline 44 of water drain line 42, so as to channel the softened fresh water or brine coming out from the resin container 30 directly into the washing tub 3 or into the drain sump or into the water filtering assembly, or into the water exhaust pump, etcetera.

Afterwards, the central control unit of laundry washing machine 1 activates the brine-circulating pump 33 to transfer/move the requested amount of brine from the regeneration-agent reservoir 31, i.e. from the basin-shaped container 49, to the resin container 30. Since the resin container 30 is completely filled with the fresh water of the water mains, the brine entering into the resin container 30 pushes out of the resin container 30 the fresh water previously stored therein. This fresh water flows along pipeline 20 of fresh-water supply line 16 towards the three-way valve 43 which, in turn, directs/channels said fresh water directly into pipeline 44 of water drain line 42.

In the example shown, in particular, the brine accumulates either on the bottom of the basin-shaped container 49 or on the bottom portion of the drawer housing 48 of the drawer-like supporting structure 47, and the brine-circulating pump 33 sucks the brine from the bottom of either the drawer housing 48 or the basin-shaped container 49.

When resin container 30 is completely filled with a sufficient amount of brine, the central control unit of laundry washing machine 1 deactivates the brine-circulating pump 33 to watertight isolate the resin container 30 from the regeneration-agent reservoir 31, and to restrain the brine inside the resin container 30 for a predetermined time interval generally sufficient to allow the brine to remove from the ion-exchange resins the calcium and magnesium ions previously combined/fixed to said resins.

When the regeneration process of the ion-exchange resins is completed, the central control unit (not shown) of laundry washing machine 1 opens again, if not already opened, the on-off valve 21 of fresh-water supply line 16 and the on-off valve 37 of electrically-controlled valve assembly 36 for enough time to allow the pressurized fresh water of the water mains to push the brine out of the resin container 30 towards the three-way valve 43 which, in turn, directs/channels said brine directly into pipeline 44 of water drain line 42.

Finally, preferably after having closed again the on-off valve 21 of the fresh-water supply line 16 and/or the on-off valve 37 of valve assembly 36, the central control unit (not shown) of the laundry washing machine 1 configures the three-way valve 43 of water drain line 42 so as to put the outlet of the resin container 30 in direct communication with the main internal washing-agent container or detergent compartment 13 of detergent dispensing assembly 9, and activates the water exhaust pump so to discharge the brine out of the laundry washing machine 1 preferably together with the washing or rinsing water already stored on the bottom of the washing tub 3, and continues the washing cycle.

The laundry washing machine 1 is therefore able to use, during the main-wash phase of the washing cycle, either softened or non-softened fresh water of the water mains or a mixture thereof. The water by-pass circuit 34, in fact, can selectively channel non-softened fresh water preferably into the internal washing-agent container or detergent compartment 13 structured to contain the detergent or other washing agent to be used in the main-wash phase of the washing cycle.

In a less sophisticated embodiment, however, the electronic central control unit of the laundry washing machine 1 may be programmed to regenerate the ion-exchange resins stored in the resin container 30 after a given number of washing cycles. This number of washing cycles may be decided by the user on the basis of an alleged hardness degree of the fresh water coming out from the water mains.

Obviously in this less sophisticated embodiment the water-hardness sensor means monitor are unnecessary.

Clearly, changes may be made to the front-loading laundry washing machine 1 as described above without, however, departing from the scope of the present invention.

Figure 5:
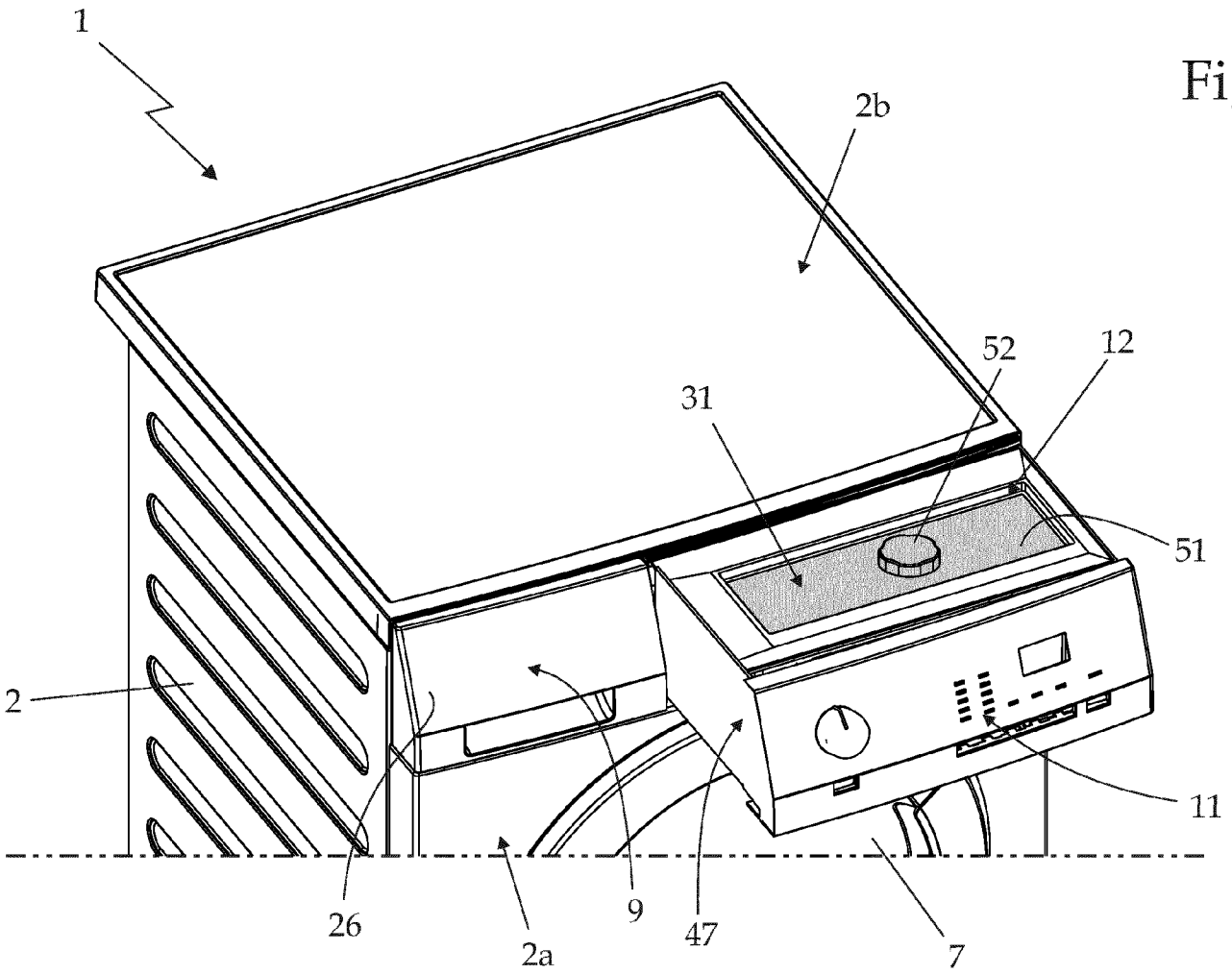
FIG. 5 is a perspective view of a second embodiment of the FIG. 1 laundry washing machine.
Figure 6:
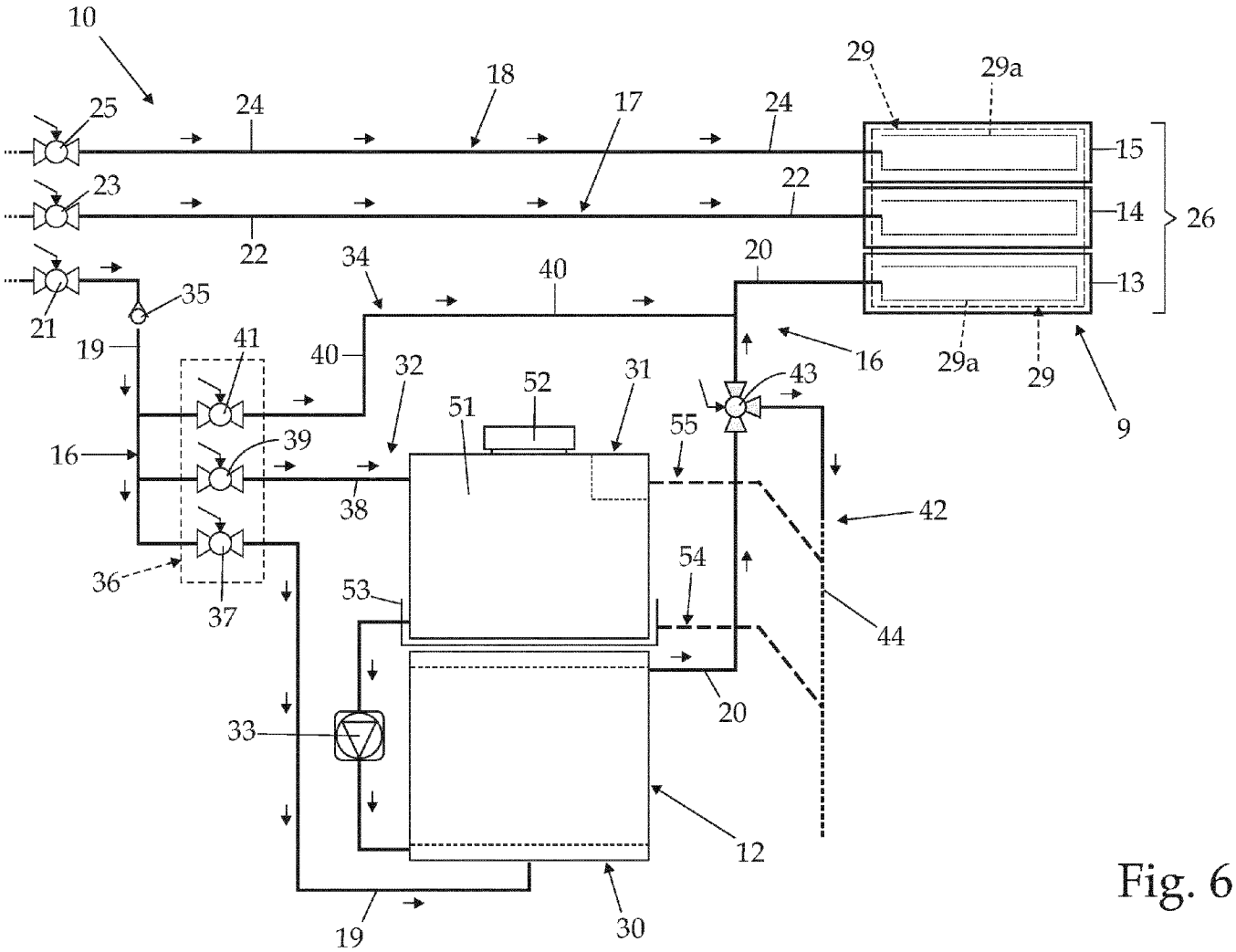
FIG. 6 is a schematic view of the internal water softening device of the FIG. 5 laundry washing machine, with parts removed for clarity.
Figure 7:
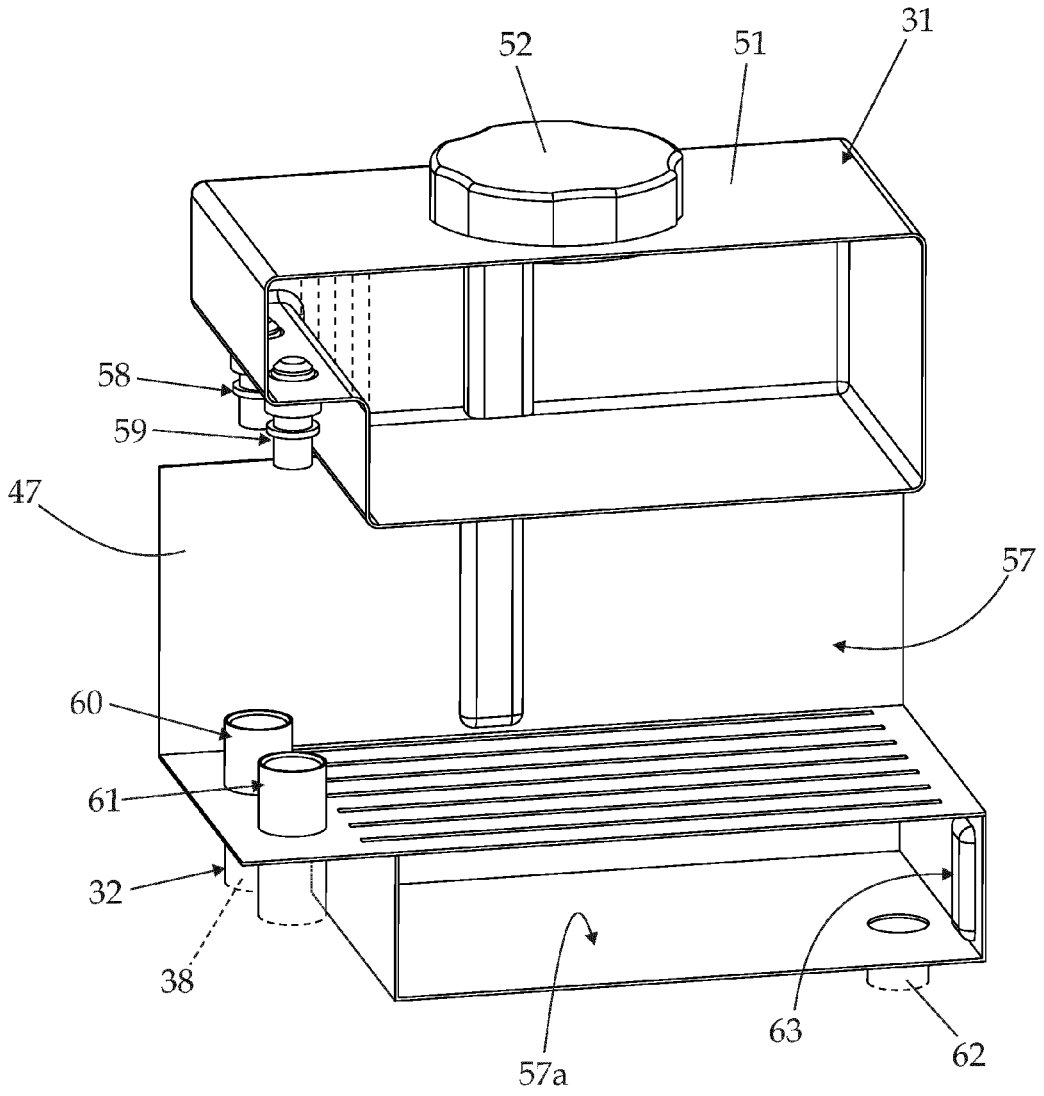

For example, with reference to FIGS. 5, 6 and 7, according to a more sophisticated embodiment of water softening device 12, the regeneration-agent reservoir 31 comprises: a preferably substantially parallelepiped-shaped, storage tank 51 which is structured for being manually fillable with a given quantity of consumable salt or other regeneration agent, and a manually-removable cap 52 which is structured to close the storage tank 51 preferably, though not necessarily, in watertight manner.

The storage tank 51 is housed into the drawer-like supporting structure 47 so to be freely accessible by the user when the drawer-like supporting structure 47 is in the completely extracted position (see FIG. 5), and to be hidden and inaccessible by the user when the drawer-like supporting structure 47 is arranged in the retracted position. The manually-removable cap 52, instead, is preferably located on top of storage tank 51 so as to be freely accessible by the user when the drawer-like supporting structure 47 is in the completely extracted position.

In the example shown, in particular, the storage tank 51 is preferably arranged/located on the drawer-like supporting structure 47 also carrying the appliance control panel 11 so that at least the manually-removable cap 52 of storage tank 51 is freely accessible by the user when the drawer-like supporting structure 47 is arranged in the extracted position (see FIG. 5), and is completely hidden and inaccessible by the user when the drawer-like supporting structure 47 is arranged in the retracted position.

Being freely accessible by the user when the drawer-like supporting structure 47 is in the completely extracted position, the manually-removable cap 52 allows the user to load the consumable salt or other regeneration agent inside the regeneration-agent reservoir 31, and therefore forms the exposable loading inlet or mouth of the regeneration-agent reservoir 31.

The water supply circuit 32 of water softening device 12, in turn, is preferably structured for channelling, on command and directly into the storage tank 51, the fresh water that flows along the fresh-water supply line 16, so as to preferably completely dissolve at once the whole salt or other regeneration agents contained into storage tank 51 and form a great amount of brine (i.e. of salt water).

In other words, in this alternative embodiment the water supply circuit 32 is no more provided with the sprinkler head 50, and the pipeline 38 directly connects pipeline 19 of fresh-water supply line 16 to the inside of storage tank 51.

The electrically-powered brine-circulating pump 33, in turn, is structured for selectively and alternatively sucking the brine (i.e. the salt water) from the storage tank 51 and delivery it to the water-softening agent container 30. Preferably the brine-circulating pump 33 is moreover structured to completely watertight seal/isolate, when deactivated, the storage tank 51 from the water-softening agent container 30, so as to prevent the brine (i.e. the salt water) contained into the storage tank 51 from flowing towards the water-softening agent container 30.

Again, the water softening device 12 preferably furthermore comprises a water-level sensor (not shown) which is structured for measuring the level of the fresh water and/or brine contained inside the storage tank 51, and/or a salinity-level sensor (not shown) which is structured for measuring the salinity degree of the brine contained inside the storage tank 51.

Preferably the storage tank 51 is moreover housed into the drawer-like supporting structure 47 either in unmovable or manually removable manner, and is furthermore dimensioned to contain an amount of brine sufficient for performing several resin regeneration processes.

More in particular, with reference to FIG. 6, the storage tank 51 of regeneration-agent reservoir 31 is preferably unmovably recessed/housed into the drawer-like supporting structure 47, and the water softening device 12 is preferably provided with a preferably substantially basin-shaped, leakage collector 53 which is realized on the drawer-like supporting structure 47 of the appliance control panel 11 so as collect the brine or water accidentally coming out from the storage tank 51 during refilling of the consumable salt.

Preferably the water softening device 12 is furthermore provided with a second water drain line 54 which fluidically connects the leakage collector 53 of the drawer-like supporting structure 47 to the washing tub 3, and is structured to directly channel the water or brine accumulating into the leakage collector 53 towards the washing tub 3.

As an alternative, the water drain line 54 may be structured for channeling the brine or fresh water accumulating into the leakage collector 53 preferably into the drain sump (not shown) that extends downwards form the bottom of the washing tub 3, or into the water filtering assembly (not shown) that is interposed between the drain sump (not shown) of washing tub 3 and the suction of either the water circulating pump (not shown) or the water exhaust pump (not shown), or substantially directly into the water exhaust pump (not shown) which drains the waste water or washing liquor outside of the laundry washing machine 1, or in any case into the waste-water drain line that channels the waste water or washing liquor outside the laundry washing machine 1.

Preferably, though not necessarily, the regeneration-agent reservoir 31 furthermore comprises, in addition or alternatively to the drain line 54, an overflow drain line 55 which fluidically connects the storage tank 51 to the washing tub 3, and is structured for directly channelling the water or brine eventually exceeding the maximum capacity of the storage tank 51 towards the washing tub 3.

Obviously the overflow drain line 55 may alternatively be structured to channel the water or brine eventually exceeding the maximum capacity of the storage tank 51 towards the drain sump, or towards the water filtering assembly, or towards the water exhaust pump, or in any case towards the waste-water drain line that channels the waste water or washing liquor outside the laundry washing machine 1.

With reference to FIG. 7, according to an alternative embodiment of regeneration-agent reservoir 31, the storage tank 51 is preferably recessed in manually extractable manner into a corresponding preferably substantially basin-shaped, complementary tank seat 57 realized on the drawer-like supporting structure 47, and is preferably provided with two self-closing hydraulic connectors 58 and 59 which are structured to hydraulically connect in easily detachable manner the storage tank 51 to, respectively, the water supply circuit 32 and the suction of the brine-circulating pump 33, preferably during insertion of the storage tank 51 into the tank seat 57.

In other words, the regeneration-agent reservoir 31 is housed into the drawer-like supporting structure 47 in manually removable manner.

More in particular, each self-closing hydraulic connector 58, 59 of storage tank 51 is specifically structured to watertight couple in easily detachable manner with a corresponding complementary, preferably self-closing, hydraulic connector 60, 61 arranged on the drawer-like supporting structure 47.

The self-closing hydraulic connector 60 directly communicates with the water supply circuit 32, that is to say with pipeline 38 of water supply circuit 32, and allows, when suitably coupled to the self-closing hydraulic connector 58, the fresh water arriving from water supply circuit 32 to freely flow into storage tank 51.

The self-closing hydraulic connector 61, in turn, directly communicates with the suction of the brine-circulating pump 33, and allows, when suitably coupled to the self-closing hydraulic connector 59, the brine stored into the storage tank 51 to freely flow out of the storage tank 51 towards the brine-circulating pump 33.

Each self-closing hydraulic connector 58, 59 of storage tank 51 is furthermore structured so as to remain closed in watertight manner when uncoupled from the corresponding complementary self-closing hydraulic connector 60, 61 of the drawer-like supporting structure 47. Similarly each self-closing hydraulic connector 60, 61 of drawer-like supporting structure 47 is preferably structured so as to remain closed in watertight manner when uncoupled from the corresponding complementary self-closing hydraulic connector 58, 59 of storage tank 51.

With reference to FIG. 7, in the example shown, in particular, the storage tank 51 of the regeneration-agent reservoir 31 is preferably structured so as to be vertically insertable into the tank seat 57 on the drawer-like supporting structure 47 when the latter is arranged in the completely extracted position (see FIG. 5). The self-closing hydraulic connectors 60 and 61, in turn, are preferably arranged inside the tank seat 57, preferably on the bottom of the same tank seat 57.

Furthermore the bottom 57*a* of tank seat 57 is preferably, though not necessarily, shaped/structured so as to form a catchment basin or other kind of leakage collector wherein the fresh water or brine leaking out of the storage tank 51 may accumulate. This catchment basin, in turn, is preferably connected to the bottom of washing tub 3 via a corresponding water drain line 62 structurally similar to water drain lines 42 and 54.

As an alternative, the water drain line 62 may be structured for channelling the brine or fresh water accumulating on the bottom 57*a* of tank seat 57 preferably into the drain sump (not shown) that extends downwards form the bottom of washing tub 3, or into the water filtering assembly (not shown) that is interposed between the drain sump (not shown) of washing tub 3 and the suction of the water circulating pump (not shown) and/or of the water exhaust pump (not shown) of the laundry washing machine 1, or in any case into the waste-water drain line that channels the waste water or washing liquor outside the laundry washing machine 1.

With reference to FIG. 7, the water softening device 12 is preferably also provided with a second water-level sensor 63 which is located on the bottom 57*a* of tank seat 57 and is able to measure the level of the fresh water and/or brine accumulated on the catchment basin formed on the bottom of tank seat 57, and the central control unit (not shown) of the laundry washing machine 1 activates the water drain line 62 when the level of brine and/or fresh water on the bottom of tank seat 57 exceeds a given threshold value.

Operation of the FIG. 6 water softening device 12 is slightly different from that of FIG. 4. In this embodiment, in fact, the central control unit of laundry washing machine 1 is preferably no more requested to channel the requested amount of fresh water into the regeneration-agent reservoir 31 at beginning of each regeneration process.

In the FIG. 6 embodiment, in fact, the central control unit of laundry washing machine 1 can open the on-off valve 39 of water supply circuit 32, together with the on-off valve 21 of fresh-water supply line 16 if not already opened, for a predetermined time interval at any time before the beginning of the regeneration process, so as to completely fill up the storage tank 51 with fresh water.

The fresh water channelled into storage tank 51 preferably dissolves the whole salt contained into the storage tank 51 and forms a great amount of brine (i.e. of salt water) sufficient for performing several resin regeneration processes. This great amount of brine remains inside the storage tank 51 until a resin regeneration process is requested to take place.

Thus, assuming that the storage tank 51 already contains a given amount of brine sufficient for performing one or more resin regeneration processes and that the on-off valve 39 of water supply circuit 32 is closed, at beginning of the regeneration process the central control unit of laundry washing machine 1 closes the on-off valves 21 of fresh-water supply line 16 and/or the on-off valve 37 of the electrically-controlled valve assembly 36, so as to stop the flow of fresh water across the resin container 30.

Almost at the same time, the central control unit of laundry washing machine 1 furthermore configures the three-way valve 43 of water drain line 42 so as to put the outlet of the resin container 30 in direct communication with pipeline 44 of water drain line 42 for channelling the softened fresh water or brine coming out from the resin container 30 directly into the washing tub 3, or into the drain sump, or into the water filtering assembly, or into the water exhaust pump, etcetera.

Afterwards, the central control unit of laundry washing machine 1 activates the brine-circulating pump 33 to move/pump the requested amount of brine from the storage tank 51 of the regeneration-agent reservoir 31 to the resin container 30.

If, at any time during pumping of the brine, determines that the level of the brine inside the storage tank 51 is too low, the central control unit (not shown) of laundry washing machine 1 may temporarily close—if not already closed—the on-off valve 37, open—if not already opened—the on-off valve 21 of fresh-water supply line 16, and finally temporarily open again the on-off valve 39 of water supply circuit 32 so to channel some more fresh water into the storage tank 51 via the water supply circuit 32.

When the resin container 30 is completely filled with a sufficient amount of brine, the central control unit of laundry washing machine 1 switches off the brine-circulating pump 33 to stop the movement of the brine from the storage tank 51 to the resin container 30, so as to watertight isolate the resin container 30 from the regeneration-agent reservoir 31.

The central control unit of laundry washing machine 1 then keeps the resin container 30 completely full of brine for a predetermined time interval generally sufficient to allow the brine contained into the resin container 30 to remove from the ion-exchange resins the calcium and magnesium ions previously combined/fixed to said resins.

When the regeneration process of the ion-exchange resins is completed, the central control unit (not shown) of laundry washing machine 1 opens again the on-off valve 21 of the fresh-water supply line 16, if not already opened, and the on-off valve 37 of valve assembly 36 for enough time to allow the pressurized fresh water of the water mains to push the brine out of the resin container 30 towards the three-way valve 43 which, in turn, directs/channels said brine directly into pipeline 44 of water drain line 42.

Finally, preferably after having closed again the on-off valve 21 of fresh-water supply line 16 and/or the on-off valve 39 of the water softening device 12, the central control unit (not shown) of the laundry washing machine 1 configures the three-way valve 43 of water drain line 42 so as to put the outlet of the resin container 30 in direct communication with the main internal washing-agent container or detergent compartment 13 of detergent dispensing assembly 9, and activates the water exhaust pump so to discharge the brine out of the laundry washing machine 1 preferably together with the washing or rinsing water already stored on the bottom of the washing tub 3, and continues the washing cycle.

The advantages resulting from the arrangement of the automatic one-way valve 35 and the electrically-controlled valve assembly 36 one downstream the other along the portion of fresh-water supply line 16 that connects the water mains to the water-softening agent container 30, i.e. along pipeline 19 of fresh-water supply line 16, are really remarkable. This particular configuration, in fact, allows to minimize the pressure drops of the fresh water flowing along fresh-water supply line 16 towards the water softening device 12.

Furthermore the automatic one-way valve 35 prevents the backflow of the brine and/or of the water from the resin container 30 and/or from regeneration-agent reservoir 31 towards the water mains.

Finally this particular configuration allows to group together the electrically-controlled on-off valves 21, 23, 25 of fresh-water supply line 16, 17, and 18, the automatic one-way valve 35, and finally the on-off valves 37, 39 and 41 of the electrically-controlled valve assembly 36, and preferably also to attach them all on the back wall of the casing 2, thus greatly simplifying the pipeline layout inside the casing 2.

Moreover, no electrically-controlled on-off valves need to be located close to the detergent dispensing assembly 9, thus greatly simplifying the structure of the detergent dispensing assembly 9 with the consequent reduction of the overall production costs of this component.

Clearly, changes may be made to the front-loading laundry washing machine 1 without, however, departing from the scope of the present invention.

Figure 8:
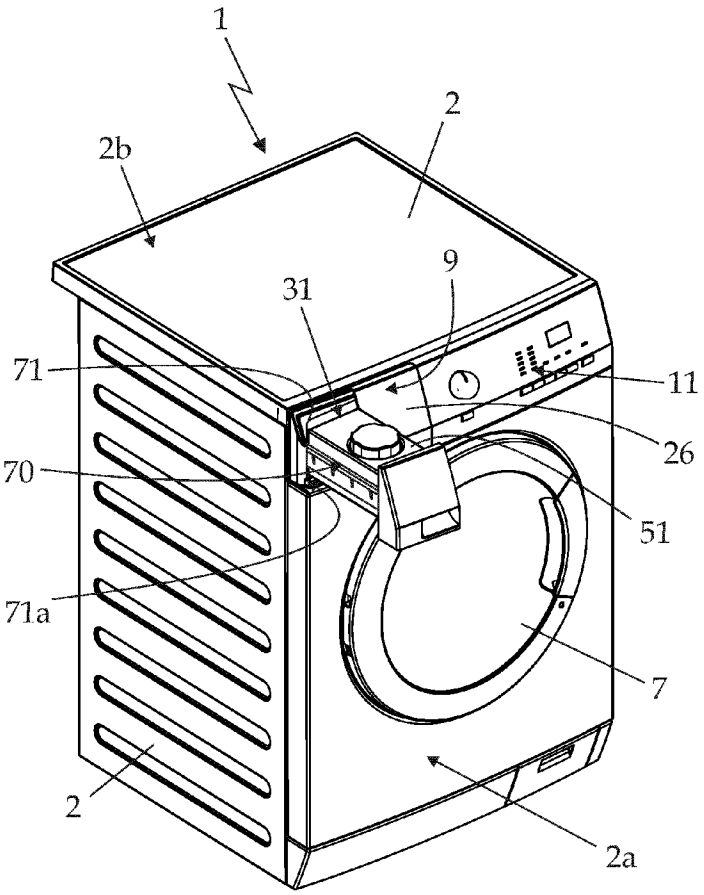

For example, with reference to FIG. 8, according to a different embodiment of the laundry washing machine 1, the appliance control panel 11 is unmovably attached to the front wall 2*a* of casing 2, preferably substantially on the upper left corner of front wall 2*a*.

The regeneration-agent reservoir 31 of the water softening device 12, in turn, is preferably located/incorporated, either in unmovable or in manually detachable/removable manner, into a drawer-like supporting structure 70 which is fitted/ inserted in manually extractable manner into a corresponding, substantially completely recessed, drawer housing 71 which, starting from front wall 2*a*, extends preferably substantially horizontally inside the casing 2 while remaining above the washing tub 3 and also immediately beside the drawer housing 27 of the detergent drawer 26, and which furthermore communicates with the outside via a front entrance or opening 71*a* which is realized on front wall 2*a* of casing 2 between the laundry loading/unloading opening and the top wall 2*b* of the casing 2, and also immediately beside the front entrance or opening 27*a* of the drawer housing 27.

The drawer-like supporting structure 70 is movable in a preferably substantially horizontally-oriented, displacement direction between a retracted position in which the drawer-like supporting structure 70 carrying the regeneration-agent reservoir 31 is completely recessed/inserted into the drawer housing 71, so as to place the regeneration-agent reservoir 31 completely inside the casing 2 and hide, i.e. make inaccessible to the user, the loading inlet or mouth of the same regeneration-agent reservoir 31; and a completely extracted position (see FIG. 8) in which the drawer-like supporting structure 70 partly juts out from the front wall 2*a* of casing 2 through the front entrance or opening 71*a* of drawer housing 71, so as to place the regeneration-agent reservoir 31 at least partially outside of the casing 2, and make freely accessible to the user at least the loading inlet or mouth of the same regeneration-agent reservoir 31.

The water softening device 12 is therefore located/arranged inside the casing 2 so that the loading inlet or mouth of the regeneration-agent reservoir 31 is exposed or exposable to the outside of casing 2, on the front wall 2*a* of casing 2, horizontally beside the exposed or exposable loading inlet or mouth/s of the detergent dispensing assembly 9, on the opposite side of the appliance control panel 11.

Furthermore in this alternative embodiment the regeneration-agent reservoir 31 preferably, though not necessarily, comprises the storage tank 51 and the manually-removable cap 52 that closes the storage tank 53.

Figure 9:
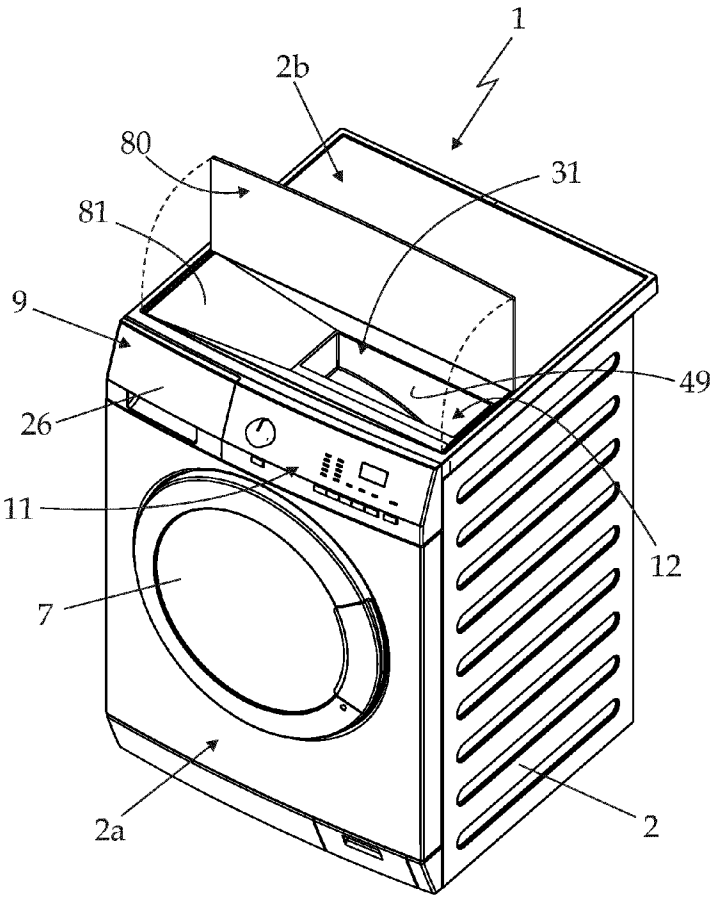
FIGS. 8 and 9 are two perspective views of further two alternative embodiments of the FIG. 1 or 5 laundry washing machine.

With reference to FIG. 9, according to a second alternative layout of the laundry washing machine 1, the water softening device 12 is located/arranged inside the casing 2 so that the loading inlet or mouth of the regeneration-agent reservoir 31 is exposed or exposable to the outside of casing 2, on the worktop 2*b* of casing 2.

More in details, in the example shown, the regeneration-agent reservoir 31 of water softening device 12 is preferably located immediately underneath the worktop 2*b* of casing 2, preferably substantially immediately behind the appliance control panel 11, and is moreover preferably freely accessible by the user through a manual-operated trapdoor 80 realized on top wall 2*b* of casing 2.

Furthermore in this alternative embodiment the regeneration-agent reservoir 31 preferably, though not necessarily, comprises the substantially basin-shaped, regeneration-agent container 49 which is completely recessed into a substantially-flat inner shelf 81 which is arranged immediately beneath the manual-operated trapdoor 80, so that the upper mouth 49*a* of the basin-shaped container 49 is freely accessible by the user when the trapdoor 80 is arranged in the raised/opened position (see FIG. 9).

As an alternative, the regeneration-agent reservoir 31 may comprises a storage tank 51 dimensioned to contain an amount of brine sufficient for performing several resin regeneration processes, and a manually-removable cap 52 that closes the storage tank 53. The storage tank 51 may again be recessed/incorporated into the casing 2 either in unmovable or manually removable manner.

In addition to the above, according to a non-shown alternative layout of the laundry washing machine 1, the appliance control panel 11 is arranged substantially immediately underneath the worktop or top wall 2*b* of casing 2, almost astride of the vertical center-plane of the casing 2, so as to be substantially vertically aligned to the laundry loading/unloading opening realized on the front wall 2*a* of casing 2, and the exposed or exposable loading inlet or mouths of detergent dispensing assembly 9 and of the regeneration-agent reservoir 31 are arranged on front wall 2*a* of casing 2, on opposite sides of the appliance control panel 11.

More in details, the detergent drawer 26 of detergent dispensing assembly 9 and the drawer-like supporting structure 47 carrying the regeneration-agent reservoir 31 may be arranged on front wall 2*a* of casing 2, on opposite sides of the appliance control panel 11.

According to a further non-shown alternative layout of the laundry washing machine 1, the on-off valves 37, 39 and 41 forming the electrically-controlled valve assembly 36 may be replaced by an electrically-controlled flow diverter which is located along the fresh-water supply line 16, downstream of the one-way valve 35, so as to have the water inlet connected to pipeline 19 of fresh-water supply line 16 and a number of water outlets respectively connected to the water-softening agent container 30, to pipeline 38 of water supply circuit 32 and, if present, to pipeline 40 of water by-pass circuit 34. The electrically-controlled flow diverter is structured for selectively and alternatively channelling the fresh water arriving from the fresh-water supply line 16 towards the water-softening agent container 30, or towards the water supply circuit 32 or towards the water by-pass circuit 34 if present.

Lastly, according to a non-shown and less-sophisticated embodiment the brine-circulating pump or pump assembly 33 may be replaced by an electrically-controlled on-off valve which is structured to selectively and alternatively put the regeneration-agent reservoir 31, i.e. the basin-shaped container 49 or the storage tank 51, in direct communication with the water-softening agent container 30 for allowing the brine to flow by gravity from the regeneration-agent reservoir 31 to the water-softening agent container 30, or completely watertight seal/isolate the regeneration-agent reservoir 31 from the water-softening agent container 30.

The invention claimed is:

1. A laundry washing machine comprising an outer casing and, inside said outer casing, a control unit, a washing tub, a rotatable drum housed in axially rotatable manner inside the washing tub and structured for housing laundry to be washed, a detergent dispensing assembly which is structured for supplying detergent, softener or other washing agent into the washing tub, a fresh-water supply circuit which is structured for selectively channeling a flow of fresh water from a water mains towards the detergent dispensing assembly and/or the washing tub, and a water softening device which is arranged/located along the fresh-water supply circuit and is structured for reducing the hardness degree of the fresh water channeled to the detergent dispensing assembly and/or the washing tub;

the fresh-water supply circuit comprising at least a first fresh-water supply line which is connected to the water mains and is structured for selectively conveying into the washing tub the detergent, softener or other washing agent of the detergent dispensing assembly; and the water softening device in turn comprising a water-softening agent container which is arranged/located along said first fresh-water supply line and is filled with a water softening agent able to reduce the hardness degree of the fresh water flowing through the same water-softening agent container; a regeneration-agent reservoir which is fluidically connected to the water-softening agent container and is structured to receive a consumable regeneration agent for performing a regeneration of the water softening function of the water softening agent stored into the water-softening agent container; and a water supply circuit which is structured for channeling fresh water into the regeneration-agent reservoir so to at least partly dissolve the regeneration agents stored therein and form brine;

wherein the water softening device further comprises: a passive one-way valve not controllable by the control unit, arranged along the first fresh-water supply line upstream of the water-softening agent container, and structured so as to allow the fresh water to only flow along the first fresh-water supply line, from the water mains to the water-softening agent container and not vice versa; and an electrically-controlled valve assembly or flow diverter which is located along the first fresh-water supply line, downstream of the passive one-way valve and upstream of the water-softening agent container, and structured for selectively allowing or preventing the fresh water of the water mains to freely flow towards, respectively, the water-softening agent container and the water supply circuit of the water softening device;

wherein the detergent dispensing assembly comprises a number of washing-agent containers each of which is manually fillable with a given quantity of detergent, softener or other washing agent, and in that the first fresh-water supply line is structured for selectively channelling the fresh water from the water mains directly to a washing-agent container of the detergent dispensing assembly structured to contain the detergent or other washing agent to be used in a main-wash phase of a washing cycle;

wherein the fresh-water supply circuit comprises further independent fresh-water supply lines each of which is independently connected to the water mains and is structured for selectively and independently channeling fresh water from the water mains to a respective remaining washing-agent container of the detergent dispensing assembly.

2. The laundry washing machine according to claim 1, wherein the water softening device further comprises a water by-pass circuit which branches off from the first fresh-water supply line upstream of the water-softening agent container, and is structured for selectively channeling, directly towards the detergent dispensing assembly, the fresh water that flows along the first fresh-water supply line towards the water-softening agent container, so as to bypass the water-softening agent container; the water by-pass circuit being connected to the electrically-controlled valve assembly or flow diverter, said electrically-controlled valve assembly or flow diverter being structured for selectively allowing or preventing the fresh water of the water mains to flow also towards said water by-pass circuit.

3. The laundry washing machine according to claim 2, wherein the first fresh-water supply line is structured for connecting the water mains to a washing-agent container of the detergent dispensing assembly, so as to selectively flush/push into the washing tub the detergent, softener or other washing agent contained in said washing-agent container; and in that the water by-pass circuit is structured for selectively channeling the fresh water that flows along the first fresh-water supply line, directly towards the washing-agent container of the detergent dispensing assembly connected to the first fresh-water supply line, bypassing the water-softening agent container.

4. The laundry washing machine according to claim 1, wherein the water softening device further comprises an electrically-powered brine-circulating pump assembly or valve assembly which is interposed between the water-softening agent container and the regeneration-agent reservoir and is structured for regulating/controlling an outflow of the brine from the regeneration-agent reservoir to the water-softening agent container.

5. The laundry washing machine according to claim 1, wherein the water softening device further comprises a water drain line which is structured for selectively channeling/rerouting the brine or fresh water that comes out from the water-softening agent container, directly into the washing tub or into a waste-water drain line that channels the waste water or washing liquor out of the laundry washing machine, so to bypass the detergent dispensing assembly.

6. The laundry washing machine according to claim 1, wherein said first fresh-water supply line comprises a first pipeline or the like which connects the water mains to an inlet of the water-softening agent container, a second pipeline or the like which connects an outlet of the water-softening agent container to the detergent dispensing assembly, and an electrically-controlled on-off valve which is located along the first pipeline or the like so as to be able to control/regulate the flow of fresh water from the water mains to the detergent dispensing assembly and the water-softening agent container; an automatic one-way valve and the electrically-controlled valve assembly or flow diverter being located downstream of the electrically-controlled on-off valve of the first fresh-water supply line.

7. The laundry washing machine according to claim 1, wherein each further independent fresh-water supply line comprises a connecting pipeline which directly connects the water mains to a corresponding washing-agent container of the detergent dispensing assembly; and an electrically-controlled on-off valve which is located along said connecting pipeline so as to be able to regulate the flow of fresh water from the water mains to said washing-agent container of the detergent dispensing assembly.

8. The laundry washing machine according to claim 1, wherein each washing-agent container of the detergent dispensing assembly is provided with a corresponding loading inlet which is exposed or exposable to outside of the casing on a front wall of the casing, and is structured for allowing the user to load the requested detergent, softener and/or other washing agent into the same washing-agent container; and in that the regeneration-agent reservoir, in turn, is provided with a corresponding loading inlet or mouth which is exposed or exposable to the outside of the casing on the front wall of the casing, beside the exposed or exposable loading inlet of each washing-agent container of the detergent dispensing assembly, and is structured for allowing the user to load consumable salt or other regeneration agent inside the same regeneration-agent reservoir.

9. The laundry washing machine according to claim 1, further comprising an appliance control panel which is structured for allowing the user to manually select a desired washing cycle between washing cycles that use non-softened fresh water during a main-wash phase of the washing cycle, and washing cycles that use softened fresh water during a main-wash phase of the washing cycle.

10. The laundry washing machine according to claim 8, wherein the regeneration-agent reservoir is recessed/incorporated into a drawer-like supporting structure which is fitted/inserted in manually extractable manner into a corresponding drawer housing which extends inside the casing and communicates with the outside of the casing via a front entrance or opening realized on the same front wall of casing; said drawer-like supporting structure being movable between a retracted position in which the drawer-like supporting structure is completely recessed/inserted into the drawer housing, so as to place the loading inlet of the regeneration-agent reservoir completely inside the casing, and an extracted position in which the drawer-like supporting structure partly juts out from the front wall of the casing so as to place the loading inlet of the regeneration-agent reservoir outside of the casing.

11. The laundry washing machine according to claim 10, wherein the regeneration-agent reservoir is recessed/incorporated into the drawer-like supporting structure in a manually removable manner.

12. The laundry washing machine according to claim 9, wherein the appliance control panel is located on a front wall of the casing so to be substantially vertically aligned to a laundry loading/unloading opening realized on the same front wall of the casing; and in that an exposed or exposable loading inlet of each washing-agent container of the detergent dispensing assembly and an exposed or exposable loading inlet of the regeneration-agent reservoir are arranged on the front wall of the casing on opposite sides of the appliance control panel.

13. The laundry washing machine according to claim 10, wherein an appliance control panel is located on a front side of the drawer-like supporting structure carrying the regeneration-agent reservoir.

14. The laundry washing machine according to claim 1, wherein the regeneration-agent reservoir is provided with a loading inlet which is exposed or exposable to outside of the casing on a worktop of the casing.

15. The laundry washing machine according to claim 1, wherein the regeneration-agent reservoir comprises a substantially basin-shaped regeneration-agent container which is manually fillable with a given quantity of consumable salt or other regeneration agent, and is located/recessed into the casing so an upper mouth of the basin-shaped container is freely accessible by the user.

16. The laundry washing machine according to claim 1, wherein the regeneration-agent reservoir comprises a storage tank which is structured for being manually fillable with a given quantity of consumable salt or other regeneration agent, and a manually-removable cap which is structured to close the storage tank.

17. The laundry washing machine according to claim 16, wherein the regeneration-agent reservoir furthermore comprises an overflow drain line which is structured for directly channeling water or brine exceeding the maximum capacity of the storage tank towards the washing tub or towards a waste-water drain line that channels waste water or washing liquor out of the laundry washing machine.

* * * * *